US006332229B1

(12) United States Patent
O'Malley et al.

(10) Patent No.: US 6,332,229 B1
(45) Date of Patent: Dec. 25, 2001

(54) AUTOMATED FLAP AND CUP CLEANER WATER-SAVING TOILET

(76) Inventors: Conor O'Malley, 1323 Glen Eyrie, San Jose, CA (US) 95125; Joseph Zappel, 8861 Berta Ridge Ct., Salinas, CA (US) 93907

( * ) Notice: Subject to any disclaimer, the term of this patent is extended or adjusted under 35 U.S.C. 154(b) by 0 days.

(21) Appl. No.: 09/789,897

(22) Filed: Feb. 20, 2001

Related U.S. Application Data

(63) Continuation-in-part of application No. 09/737,427, filed on Dec. 13, 2000, now abandoned.

(51) Int. Cl.[7] ..... E03D 11/10

(52) U.S. Cl. ..... 4/438; 4/325; 4/326; 4/440; 4/441; 4/442

(58) Field of Search ..... 4/300, 313, 234, 4/324, 325, 326, 415, 434–436, 438–442, DIG. 3

(56) References Cited

U.S. PATENT DOCUMENTS

| | | | | |
|---|---|---|---|---|
| D. 413,658 | | 9/1999 | Birsel | D23/311 |
| 532,656 | * | 1/1895 | Fryer | 4/234 |
| 965,400 | | 7/1910 | McPherson . | |
| 1,163,149 | | 12/1915 | Hoofer . | |
| 1,543,311 | | 6/1925 | Anderson . | |
| 1,629,401 | | 5/1927 | McCall . | |
| 1,779,642 | | 10/1930 | Schumacher . | |
| 2,258,454 | | 10/1941 | Johnson | 4/85 |
| 2,675,562 | | 4/1954 | Duner . | |
| 2,816,294 | | 12/1957 | Duner | 4/8 |
| 3,626,521 | | 12/1971 | Delco | 4/85 |
| 3,720,962 | | 3/1973 | Harrah | 4/85 |
| 3,786,522 | | 1/1974 | Kira | 4/237 |
| 3,921,235 | | 11/1975 | O'Neill | 4/234 |
| 3,939,500 | | 2/1976 | Miller | 4/10 |
| 3,968,526 | | 7/1976 | Harrah | 4/52 |
| 4,233,696 | | 11/1980 | Ibel | 4/237 |
| 4,457,029 | | 7/1984 | Mathews | 4/234 |
| 5,199,112 | | 4/1993 | Locarno | 4/239 |
| 5,867,843 | * | 2/1999 | Robello et al. | 4/246.1 |
| 6,070,276 | * | 6/2000 | Yeung | 4/442 |

FOREIGN PATENT DOCUMENTS 5-228069 * 7/1993 (JP) .

* cited by examiner

*Primary Examiner*—David J. Walczak
*Assistant Examiner*—Tuan Nguyen

(57) ABSTRACT

A gravity drop-toilet uses main water via electronically programmed valves to rinse separate areas of a bowl (71) in sequence via appropriately located and pointing jet orifices (136, 138,140) with about 70% less water than siphon toilets. Electronically timed valve (180) hydraulically causes a pair of bellows (110) to compress and expand and thereby reversibly pivot a mechanical linkage to retain waste in the bowl and drop waste via a vertical waste passageway into a sewer pipe (30). The linkage comprises a transfer arm (118) that pivots a rotating arm of a cup (128) and flap actuating arm (104) to pivot a springy plate (78) upward against a dimple (80) formed on under the side of the flap (30) which thereby aligns itself against the bottom edge (74) of the bowl (71). A urine version of this mechanism uses apertures (174, 175) that they enclose combine to center defecating sitters over a cylinder outlet (48) of the bowl. These parts and apertures prevent waste from smearing the seat, rim, and back of the bowl. Water valves (178) and (183) respectively respond to hand plungers 29 and 31 so that the toilet also works during an electric power outage. The toilet is programmable and more user friendly.

17 Claims, 22 Drawing Sheets

AUTOMATED FLAP AND CUP CLEANER WATER-SAVING TOILET

CROSS REFERENCE TO RELATED APPLICATIONS

This application is a continuation-in-part of application Ser. No. 09/737,427, filed Dec. 13, 2000, now abandoned.

FEDERALLY SPONSORED RESEARCH

None

SEQUENCE LISTING OR PROGRAM

None

BACKGROUND

Field of Invention

This invention relates to toilets, particularly to an automated water-saving rinsing system for a toilet.

Definitions

To help make this description of prior-art toilets and our toilet clearer and easier for the reader, we use the nouns liquid waste and solid waste and the verbs, to rinse, to flush, to jet, to carry, and to infuse and in the following manner:

By solid waste we mean stools, toilet tissue, paper, sanitary napkins, cigarettes, and other solids commonly jettisoned into toilets.

By liquid waste we mean urine or water stained by particles of solid waste.

By to rinse, we mean to use water to dislodge human waste from surfaces inside of toilets.

By to flush, we mean to expel human waste, or other material, from a toilet into a sewer pipe.

By to carry, we mean to move solid waste (or test material that represents solid waste), towards a sewer main. The primary purpose of a domestic or commercial toilet is to carry human waste from a bathroom, or a water closet, to a sewer main.

By to jet, we mean to supply water under pressure to rinse a toilet.

By to infuse we mean to introduce clean water into a toilet part to create a clean water seal.

We believe that a toilet ideally does the following:

Carries human waste to a sewer main with one flush.

Rinses the first time.

Conserves more water than conventional toilets.

Expels fecal odors from the bathroom.

Periodically renews its water seals, and

Centers, or helps seat, sitters so that their feces do not foul the seat, rim, or the bowl.

Prior Art

In a toilet there are methods and structures that are used to create a mandatory water seal against sewer gas and to regulate the passage of waste through a waste passageway, from a toilet bowl to a sewer. The principal distinctions between prior-art toilets and ours relate to such methods and structures, i.e., to such a seal and to such regulation. We draw attention to the following classes of toilets based on such distinctions:

There are three types of conventional flap and cup toilets: those provided with a flap, a cup, a combination of flap and cup, flap and flap, and a combination cup and cup. In some a cup and cup, or flap and flap, rotate open and closed one above the other under a toilet bowl. The upper member rotates against and away from the bottom of the bowl to create a water seal and regulate the passage of waste from the bowl. The rotation of the lower member serves a variety of other functions that are mandatory in trains, boats, etc. but not in buildings.

A cup toilet has a cup under a bowl, inside of a waste passageway. The cup rotates to regulate the passage of waste and to create a water seal.

A flap toilet has a flap under a bowl. The flap rotates open and closed with respect to a bowl inside of a waste passageway and thereby regulates the passage of waste and creates a water seal.

The waste passageway of a siphon toilets per se is a siphon structure. The siphon structure, by acting siphonically as described below, carries waste for the bowl towards a sewer main. In addition, as described below, the siphon structure per se acts as a water trap to create a water seal.

We will discuss these types of toilets seriatim.

Flap Toilets: Various kinds of hinged and rotatable flap-valves are described in U.S. Pat. Nos. 3,720,962 and 3,968,526, to R. Harrah in March 1973 and July 1976.

Microphor Inc., a manufacturer of toilets, at Willits, Calif., makes a toilet with a pivotally hinged flap valve. The flap opens and closes when the user activates a lever. This toilet is regarded as an ultra-low flush. It uses approximately 950 to 1,800 mls of rinse and flush water each time a user actuates a lever. This toilet is inadequate for conventional dwellings, workplaces, cities, etc., or in regions where water is more plentiful for the following reasons:

The flap has four functions; to retain waste in a bowl; to regulate the passage of waste from the bowl; to create a water seal between the bowl and a hopper to seal the bowl against sewer gas, and to provide water in to which feces may fall.

When open, the flap allow the contents of the bowl to fall gravitationally into a hopper. When closed, the flap retains waste or rinse water in the bowl. The water seal is small. The water seal is the only water in the bowl when a person defecates. The Microphor toilet rinses large areas of the bowl poorly and some areas not at all. Consequently despite rinsing, solid waste readily and commonly sticks to the bowl and remains there to greet the next user.

A remote external air compressor pressurizes a hopper-air chamber. The hopper is downstream to, and behind and below, the flap. It forces waste into a sewer pipe. The waste passageway of this toilet is relatively long, tortuous, and narrow compared to those of other conventional toilets. The compressor is very noisy and best kept far from bedrooms, dining rooms, workplaces, etc.

The Microphor toilet can be difficult to use. The user must press down a control lever on the back wall with a hand or foot. The user must hold the lever down to keep the flap valve pivoted open long enough to permit the contents of the bowl to slide into the hopper. Furthermore, the user must release the control lever in a timely fashion after waste leaves the bowl or else the compressor will not pressurize the hopper. If the hopper is not properly pressurized it cannot evacuate. Consequently, the waste will remain in the hopper. If the user fails to use the foot switch at all, the waste remains in the toilet bowl.

A gasket prevents pressurized solid and liquid waste from backing into the bowl from the hopper. However, the gasket and the gasket sealant are prone to deteriorate. Feces can stick to and visibly smear the deteriorated gasket or sealant. Fecal particles, easily missed on casual observation, can readily lodge in the crevices between the gasket and the sealant, and the bowl proper.

Further, the inside diameter of the tube that carries waste from the hopper to the external drains is only 34 millimeters wide. The tube makes one or two right angle bends. Accordingly, slender short foreign bodies, such as a 5 cm tooth pick or a bobby pin, can readily clog the tube. This toilet requires relatively high maintenance.

Consequently, the Microphor flap toilet can be suitable for a few, but not most, water closets or bathrooms in industrialized countries.

Cup Toilets; U.S. Pat. No. 3,939,500 to M. Miller, C. Vanden Brock, B. Stansbury, Jr, T. Jamison, C. Mc Hose, and P. Dubson, February, 1976, U.S. Pat. No. 2,275,562 to S. Duner, April 1954, and U.S. Pat. No. 3,626,521 to E Delco, December 1971 describe toilets. Each of the above toilets is provided with a pivotable cup-shaped valve. The cup-shaped valve serves two functions; it controls the passage of human waste and it creates a water seal.

However, each of the above-mentioned cups contacts human waste and soiled toilet tissue before and during flushing. When feces stick to a cup the feces soil whatever water the closed cup holds. Consequently, the above mentioned cups readily soil the water seals that they create. For example, the Duner patent describes a water-spraying mechanism for rinsing particles that stick to a bowl-shaped upper pan.

A conventional cup only toilet is provided with a relatively shallow cup. When water in the bowl is higher than the lip of the cup it promptly leaks into the sewer until the water in the bowl is at the level of the lip of the cup. Thus the water seal is the only water in the bowl when a user defecates. Consequently, almost all of the bowl is dry while a user is defecating (Stools are more likely to stick to a dry bowl than to a wet one. They are least likely to stick to a bowl if they first fall into water.) Consequently, stools that smear cup-only toilets are harder to rinse.

Furthermore, if the user opens the cup too slowly water can escape without flushing solid waste.

For example, a cup toilet made by Valterra Products Inc., 720 Jessie Street, San Fernando, Calif. 91340 is sold under the trademark La Toilette. Rinsing and flushing of this toilet depend on the proper uses of two hand levers and, hence, on the attention, courtesy, and skill of the user.

Also, the space through which waste falls in the Valterra cup toilet is very large. That can be a source of problems. The user can readily rotate the cup upward rapidly against falling solid waste. Thus, without meaning to, or knowing, the user can fling the waste against the large dry, or relatively unrinsed, surfaces under the bowl. The waste can adhere there, dry, and become hard. Feces can continue to build up over time. Thus, replacing such a toilet can be an offensive and contamined chore.

Lastly, this toilet makes no provision for preventing rats or coachroaches that commonly infest sewers from entering the large space between the cup and the sewer within the body of the toilet.

Consequently, the Valterra cup toilet can be suitable for a recreational vehicle. However, it is not suitable for water closets or bathrooms in residences, businesses, or public places in industrialized countries.

Toilets with an Upper and a Lower Valve: The toilet valves described in U.S. Pat. No. 1,543,311, to G. Anderson, June, 1925, U.S. Pat. No. 2,816,294, to J. Duner, December 1957, U.S. Pat. No. 2,675,562, to S. Duner, April 1954, U.S. Pat. No. 2,258,454, to C. Johnson, October 1941, U.S. Pat. No. 1,779,642, to J. Shumacher, October, 1930, U.S. Pat. No. 1,69,401, to J. Mc Call, May 1927, and U.S. Pat. No. 965,400 to W. Mc Pherson, July 1910 are inadequate for conventional buildings connected to conventional sewers for the following reasons:

In no case in which an upper or a lower valve is a flap or a cup is the cup adequately designed for the sole purpose of providing a clean water seal. In no such case is the flap designed, or adequate for preventing solid waste from contacting the cup.

Additionally, in no case in which the toilet has an upper and a lower toilet valve is the lower valve designed, or adequate, for creating a water seal above the upper valve.

Furthermore, in no case is the upper valve adequate for preventing feces, or fecally-soiled tissue, from coming in contact with the lower valve.

One purpose of the above conventional valve-combinations is to permit the toilets to flush on to a railway bed only when a train is moving, hopefully outside of a station. This prevents users from flushing, while the train is at rest within the station. Another purpose of the above combinations is to prevent air under a moving train from forcing its way into a toilet on a train and spraying waste into the bathroom or at the user.

For example, the Anderson patent describes a control mechanism that is actuated by and dependent on the movement of the train.

The Schumacher patent describes two cup-like valves that regulate the passage of waste between the upper and lower compartments of a hopper. When the one of the cups described in the Mc Call patent is open, the other cup is in a completely closed position.

Siphon Toilets-Siphon Structures and Siphon Theory

The vast majority of the toilets in the United States, and in the industrialized world, are siphon toilets. Siphon toilets rely on siphonic action to carry human waste from a bowl through a relatively long and convoluted siphon structure into a sewer.

A siphon structure can bend sharply 5 times; once upstream of a weir, once at the weir, and 3 times downstream of the weir. The inside diameter of a siphon structure is relatively narrow. It can vary from 43.75 mm to 62.5 mm. Siphon theory and study of a siphon structure help us to understand why a siphon toilet can readily clog. They also help us to understand why, following what appears to be a successful flush, water always refluxes back into the toilet bowl from a siphon structure.

Siphon theory is treated briefly in The Encyclopedia Britannica, Volume 10, Micropedia-Ready Reference, under Siphon on page 843. It is treated in further detail in The Encyclopedia Britannica, Volume 23, Macropedia-Knowledge in Depth, under Siphon on pages 748 and 749.

Siphon theory explains the physical nature of siphon action. The theory helps us to understand how a siphon-toilet transports waste to a sewer pipe. Siphon theory also helps us to understand why force must be used to prime a siphon structure or siphon toilet to start a siphon action. Most siphon toilets rely on the weight of water falling from a tank into a bowl to start a siphon action. Some siphon toilets rely on pressurized water from a water main or a pump to initiate a siphon action.

Any time the upper level of water in the bowl of a siphon toilet is higher than the highest part, or weir, of its siphon structure, water spills over the weir, transits the remainder of the siphon structure, and falls into a sewer pipe. If water floods, or primes, the full cross-section above the weir, siphon action, or siphonage, can occur. Siphon toilets depend on siphonage to propel liquid and solid waste to the sewer pipe. The diameter and mass, of stool and toilet paper that a given siphon toilet can flush to a sewer is limited by two factors, gravity and continued cohesiveness of water.

For siphon action to start and to continue, it is essential that water be coherent on both sides of the weir; the water molecules must stick to each other. Under such conditions, the gravitational pull on the water downstream of the weir causes water to flow siphonically. Cohesiveness continues as long as air pressure is higher than the water vapor pressure at a given temperature. Consequently, cohesiveness prevents water from breaking apart under its own weight at the weir. Without cohesiveness the water on both sides of the weir falls gravitationally. The water downstream of the weir falls into the sewer pipe and the water between the weir and the bowl falls, refluxes, back into the bowl. According to siphon theory, the presence of air in water breaks molecular cohesiveness. The following explains why every siphon toilet eventually refluxes water as the end of each flush.

Towards the later stage of a flush, water in a toilet bowl drops below the top of the entrance to the siphon passageway. As soon as the water is below the entrance, air enters the passageway and floats buoyantly up to the weir. Air in the water at the weir promptly undoes the cohesiveness of the water at the weir. Consequently, the water on either side of the weir collapses gravitationally. Accordingly, the water between the weir and the bowl reappears in the toilet bowl and the water downstream of the weir falls towards a sewer pipe. Thus, if there is particulate fecal waste or tissue between the bowl and the weir it automatically refluxes into the bowl.

Refluxing is an inherent characteristic of siphon toilets. Accordingly, siphon toilets commonly reflux waste and this requires extra flushing. Whither they be primed gravitationally by a tank, or by a pressurizing pump, or by a water main siphon toilets reflux. Consequently, siphon toilets commonly reflux waste that requires further flushing.

To aid understanding, as stated, we use the verb to carry to mean to move solid waste, liquid, or test materials representing solid waste, through a toilet waste passageway or through a sewer pipe.

To carry solid waste and liquid a toilet must impart momentum to the waste and liquid. When moving liquids and solid waste strike or round a bend they loose momentum. Siphon structures can bend sharply as many as 5 times. Consequently, siphon structures per se reduce the carrying power of siphon toilets.

Accordingly, an abrupt loss of the propelling effect of a siphon action commonly causes feces and toilet paper still in the siphon passageway to clog the convolutions of siphon structures. Recourse to further flushing may unclog a passageway. However, it takes more energy to start a mass moving a second time than to keep it moving a first time. Consequently, a second attempt at flushing to unclog a siphonic waste passageway often fails. Since, at this point, a bowl often contains more water than usual, an extra flush can cause the bowl to overflow onto the floor.

Consequently, a plumber's plunger may be needed to resolve such a clog. If the plunger fails, a snake is needed. However, using a plunger or a snake to clear a siphon passageway is distasteful. Furthermore, it takes knowledge, skill, and patience to clear a siphon with a snake without damaging the passageway.

Further, in the cases of refluxed waste, or clogged passageways, if the user does nothing and merely walks away, the next user is confronted with a repulsive sight and odor. Thus the user may be faced with the choice of using a plunger or snake to dislodge the waste of another person or also simply walking away. Such misadventures and choices happen all to often, especially in, public bathrooms because there users are less likely to act with the care, attention, and consideration that siphon toilets demand. In addition, from the point of view of flushing efficiency, refluxed water is water squandered in the sense that it does not contribute to the intended flush.

Other Problems with Siphon Toilets

Normal adults urinate approximately 300 ml six times a day and they defecate as often as four times a day, or as little as once in four days, depending upon the amount of cellulose and fiber in their diet and the motility of their alimentary canal. On average, normal adults defecate once a day.

In the United States, as stated, the vast majority of people use siphon toilets. They use the same amount of water to flush liquid as they do to flush solid waste. Thus, the average person flushes approximately thirty-eight to seventy-seven liters a day into a sewer depending upon whether their toilet uses six, or twelve, liters of water per flush. In some countries some users have the option of using a lesser volume of water to flush urine than solid waste. Thereby, they reduce the cost of water for all and conserve water so that others can build where toilet water is scarce. However, such toilets are far from the norm.

Additionally, the operation of a siphon toilet requires that users cooperate in ways that they all too often neglect. Consequently, later users commonly encounter a toilet bowl that has not been flushed.

Furthermore, not all siphon toilets flush equally well. Formerly, siphon toilets were primed and powered by twenty-eight liters that fell from a tank located as much as 183 centimeters above the bowl. Such a powerful force and volume of water was sufficient to carry waste into a sewer pipe without permitting soiled waste to reflux back into the bowl. Unlike current siphon toilets, those siphon toilets rinsed and flushed well.

Also, the vortex action that occurs at the end of a siphon flush as water spins out of the bowl—the Coriolis Effect—frequently pulverizes solid waste and toilet paper, clouding the water with particles. Consequently, these particles are likely to reflux back into the bowl and contaminate the water seal.

Furthermore, stools may stick to the porcelain bowl and may resist further rinsing. In a pump-assisted siphon toilet the jet of water is narrow and at the bottom of the bowl. Its main purpose is to pump water into the siphon passageway to prime and sustain the siphon action. Consequently, relatively little water or water pressure remains for rinsing, especially the upper inside of the bowl. Stools that resist rinsing become dry and more adherent.

For siphonic action to happen three things must occur:

(1) the ascending arm of the siphon structure must fill with water, (2) the siphon structure at the level of the weir must fill with water, and (3) part of the siphon structure downstream of the weir must fill with water.

This priming action consumes about two liters of water. Moreover, most feces are heavier than water. Consequently, before feces can leave the bowl of a siphon toilet about two liters of water have already been squandered.

(Consumer Reports, in May 1998, reported that some factories set the water level in the tank to deliver more than the mandated six liters. This of course, makes them appear better than they are. Not surprisingly, a black-market in the older and more powerful, and more reliable water-guzzling toilets exists along the Mexican and Canadian borders for those users who want toilets that rinse and flush better. To summarize, the conventional siphon toilet, designed to save water, is no longer as good as it used to be when it used more water.

Toilets must conserve more water for the following reasons: Purified water that is squandered has to be replaced at great expense to all. In many places in the West, e.g., Tracy, Carmel, Monterrey, and Dougherty Valley in Calif., new homes and remodeling of existing homes are in danger of coming to a complete stop for lack of water.

Nine western states receive water from the Colorado River. Burgeoning populations have brought these states to the point where they can wring no more water from that mighty river. By the time it reaches Mexico it is almost dry; in the past it used to flood large areas of upper Mexico.

In the US, 29 western, southern, and eastern states suffer some degree of water shortage. Ten mid-atlantic and northeastern states observe voluntary and mandatory water restrictions to combat drought (Andrea Tortori in USA Today Aug. 4, 1999).

In a twelve-site study conducted across the United States by the AWWA Research Foundation in 1999, the vast majority of residential toilets were siphon toilets. They use and discharge 26% of all water used indoors. Depending on the tank sizes of their toilets, !4% of households average less than 7.6 liters per flush, 34% between 7.6 and 13 liters per flush, and 50% average more than 15 liters per flush (American Water Works Association—AWWA—and the Association of Metropolitan Water Agencies, AMWA, waterwiser.org, Residential End Uses of Water, Water Use: Indoor & Annual.)

Most newer cities in America have two separate sets of water pipes downstream—one for sewage, one for street runoff. The sewage runs to sewage treatment plants. The run off runs to a bay, etc. However,in older cities, such as New York, Boston, and San Francisco usually the two systems of pipes combine and run to common water treatment plants. These systems work well in summer. However, rain storms cause problems. A vast inflow of rainwater mixes with sewer effluent and overwhelms the city's treatment plants, resulting in "overflow events."

For example, very wet weather, untreated sewage floods onto and contaminate the beaches on San Francisco's Pacific coast and San Francisco Bay. People stay away to avoid being infected by coliform bacteria of fecal origin. In 1999 there were 23 such beach "incidents." This was considered to be a sign of progress; before the city upgraded its sewage system at a cost of $1.6 billion, there were more than 80 incidents in an average year (Giving Rain the Treatment, S.F's Sewer has Fewer Overflows but Storms Still Spell a Challenge, Glen Martin, Chronicle Environment Writer, San Francisco Chronicle, Jan. 4, 2001, www.sfgate.com).

American water experts agree that increased water conservation must become a big part of the answer to water-scarce and drought-prone states and that using less flush water should be a big part of this conservation.

Some of the largest cities in the world are periodically forced to do without water to conserve scare a scarce supply of water. For example, people living in large Japanese cities, including Tokyo, can receive no water for several hours a day in summer.

The water-regulating apparatus in a conventional toilet can leak a significant amount of water into sewers. According to the American Water Works Association, mentioned above, one in five toilets leak about 7% of all the water used indoors in America. Householders commonly lack the skill and tools to repair or replace a faulty water-regulating apparatus, especially within the narrow and rigid confines of a low-flow tank.

Conventional pump-toilets that rely on electricity to rinse or to flush cannot continue to rinse or flush during a power outage. Conventional suction-toilets that rely on electricity for flushing cannot flush during a power outage.

Few conventional toilets harness the power of a water main to rinse or to flush.

Many people are psychologically conditioned to experience an urge to urinate and defecate on hearing running water in a bathroom. For some this conditioning is powerful. Many who use siphon toilets run a faucet to promote urination and defecation. Others continue to sit and delay those who are waiting to use the bathroom. Consequently, this problem occurs especially in crowded public bathrooms provided with siphon toilets.

In addition, the pitch of a sewer pipe downstream to a toilet may result in clogging of the sewer pipe. Such a clog must be removed. There are conventional plumbing attachments that fit onto a garden hose which, when attached to a faucet, inflate a balloon that seals a sewer pipe hermetically and cause water pressure hydraulically to undo clogs. However, the makers explicitly warn people not to attempt to use these devices in siphon toilets; attempts to do so may damage the convoluted waste passageways, usually made of vitreous china. The conventional approach to a clogged sewer is through a clean-out. Such work is usually best left to a professional plumber.

Furthermore, sewers are often home to numerous rats and roaches. Rats can climb a siphon passageway and enter the bowl through a siphon water seal.

Additionally, many people, least they bacteriologically contaminate themselves, refuse to touch a lever, door, doorknob, or wall of a water closet or bathroom, especially in public facilities in which a prior user left the toilet soiled.

The tanks and pumps of conventional toilets fill too slowly for many people. When confronted with a need for a second rinse or flush, many people simply walk away. They leave waste for the next user to rinse or flush rather than wait for the tank or pump to refill.

Siphon toilets compete with showers for water. Thus, by withholding water from showers, they can cause annoying changes in the temperature of shower water.

Prior Automation: Many commercial toilets rely on a motion sensor automatically to trigger a flush as soon as the user moves away from the seat. Often the motion sensor does not work. When it works as designed, users in the habit of standing to wipe do not have time to wipe. Consequently, the latter face a bowl that automation has emptied prematurely. To flush those users have the choice of using the button provided, sitting down, and then moving away again, or learning that to trigger a flush one must hold a hand in the path of the motion sensor for about six seconds. Frustrated, or not caring, the user may simply walk away and leave the bowl and its contents to the next user.

For the same reasons, motion sensors do not well serve those who stand to urinate. Those who stand to urinate may abandon the toilet and its contents rather than persist in trying to empty the bowl. Consequently, while some conventional siphon toilets are programmed their programs do not allow for the variety of peoples, cultures, and regions that use toilets.

Likewise many people throw other solids, such as cigarette butts, matches, paper, etc. into stand-up wall-mounted urinals as if they were toilets. Consequently urinals commonly clog and overflow.

Apertures and Slopes of Seats and Rims

The size and configuration of the apertures in a seat and rim are two of the factors that determine whither feces soil the seat and rim. When a user sits too far back with respect to the apertures enclosed by the seat and rim, feces readily stick to the top of the seat, to the undersurface of the seat, to the rim, and to the rear of the toilet bowl. Few tasks are as unpleasant as having to clean a toilet seat or a toilet rim soiled by another.

Stools are least likely to adhere where the bowl is steepest and water is deepest—at the outlet of the bowl. Thus, to reduce the need for rinsing the bowl, ideally the rear of the seat of a toilet is sloped to center users directly above the outlet of the bowl.

Consequently, the configuration and dimensions of the apertures enclosed by the seat and rim and of the slope of the seat and rim and the location and configuration of the deepest part of a toilet all combine to determine where feces fall. They determine whither feces stick to the seat, rim, or rear of the bowl or not. Conventional toilets commonly permit feces to smear the seat, rim, and rear of the bowl.

Conventional toilet seats and rims enclose apertures. Some conventional toilet seats are provided with a sloping rear part. U.S. Pat. No. 5,199,112 to M. Locarno, April, 1993, U.S. Pat. No. 4,457,029 to H. Mathews July 1984, U.S. Pat. No. 3,786,522 to A. Kira January 1974, U.S. Pat. No. 3,921,235 to R. O'Neil November 1975, U.S. Pat. No. 4,233,696 to M. Ibel November 1980, U.S. Pat. No. 1,163, 149 to L. Hooper December 1915, and design U.S. Pat. No. 413,658, to A. Birel, September 1999 all show or describe sloping toilet seats designed to position people for greater comfort or to help them to void.

However, users can readily soil the seat, rim, and rear wall of the bowl of each of the above toilets because the apertures enclosed by the seat and rim do not give the feces of a person sitting on the seat ready free-fall access to the bowl.

Furthermore, conventional toilet seat and lid combinations rely on moorings that fail to keep the seats or the lids secure, aligned, or comfortable for long.

Additionally, conventional toilets are inadequate because they are designed under the following implied assumptions:

Everyone is of a standard height, posture, and physical ability,

Everyone is courteous enough to leave the toilet clean,

Everyone is familiar with toilets and how they work, and

Human intestines work alike.

For example, the design of conventional toilets assume that every one expels feces straight down, whereas in reality many normal people spatter soft feces far and wide, horizontally, and even upwards, against upper parts of the bowl which conventional toilets usually rinse poorly. Should the latter happen despite repeated rinses, the feces can stay stuck to the bowl. If allowed to dry and solidify, someone eventually has to scrape off the feces by hand.

Furthermore, many people can't sit in comfort on existing toilets because they are too low. Others can't sit in comfort because they are too high.

Despite their efforts to keep long clothing dry and clean, the clothes of toilet users often slip down into a bowl.

Many people dislike sitting on a toilet seat unless they have a disposable seat cover between them and the seat. If a seat cover is not available, some people squat over the toilet without touching it. The latter method is apt to soil the seat, the rim, or the back wall of the bowl.

A variety of disposable seat covers are available. They slip off easily or require expensive structural changes to the toilet.

In summary, flap toilets, cup toilets, upper and lower valve toilets, and siphon toilets are inadequate for the following reasons: They often fail to rinse or to flush feces. They often fail to create a clean water seal. Conventional toilet design is not user-friendly; conventional toilet design is based on a variety of false assumptions about flow people use toilets and about the people themselves. Additionally, siphon toilets squander water.

Objects and Advantages

Accordingly, several objects and advantages of our toilet are:

To provide an improved and water-efficient toilet,

To provide a toilet which rinses better than siphon and valve toilets;

To provide a toilet that flushes better;

To provide a toilet that rinses and flushes with less water;

To provide a toilet which, per se, carries more efficiently;

To provide an improved toilet for residences, businesses, and public places;

To provide a toilet bowl to which masses of stools are less likely to stick or to smear;

To provide a toilet interior that automatically self cleans in a superior manner;

To provide an automatically self-flushing toilet that allows people time to stand to wipe before it flushes;

To provide a toilet that rinses, flushes, and retains a clean seat and rim during an electric-power outage;

To provide cleaner water seals;

To provide a toilet seat and rim less apt to be soiled by feces;

To provide a toilet and bathroom which remain cleaner to touch;

To provide a toilet exterior that is easier to clean;

To provide a toilet that gives off less odor;

To provide a toilet which is more user-friendly that conventional toilets.

To provide a toilet that denies entry to rats and cockroaches;

To provide a toilet that carries waste to a sewer more hygienically and with less interference than siphons, conventional flaps and cups, or combinations of them;

To provide a toilet that is less likely to clog or overflow;

To provide a modular toilet whose modules and parts a handy person can readily replace with common tools, and To provide a toilet that accommodates deviations from the ruling assumptions, about the height, physical ability, courtesy, cultural customs, and the character of the feces of toilet users, that conventional toilets follow.

Still further objects and advantages will become apparent from the following description and drawings.

SUMMARY

In accordance with the present invention, a toilet comprises a rotatable flap and cup that are opened and closed, in a series of overlapping motions, by hydraulic pressure acting on a mechanical linkage system. The flap retains and releases waste from a bowl. The flap also shields the cup from waste, thus making possible a cleaner water seal—the sole function of the cup. Rinsing is the result of available main-pressure jet rinsing at least one area of the bowl at a time. Rinsing occurs automatically whenever someone sits on a seat. This method of rinsing cleans the bowl better and with much less water than rinsing all areas of the bowl at one time with only part of the available hydraulic pressure. The rinse water accumulates above the flap where it cushions falling feces. The toilet flushes automatically. The flap and cup open, the water and feces fall gravitationally into a sewer pipe. Since our toilet rinses and flushes with the same water at different times it operates and stays cleaner with much less water than toilets that rinse and flush with the same water at the same time. A seat and a rim and apertures enclosed by them are shaped and sized to center sitters over the deepest and steepest parts of the bowl, where the accumulated water best cushions feces, and they permit feces to fall free without soiling the seat or rim. Our toilet rinses and flushes during a power outage. Our toilet is more user-friendly.

DRAWINGS

Figures:

In the drawings, closely related figures have the same number but different alphabetical suffixes.

Figure 19A:
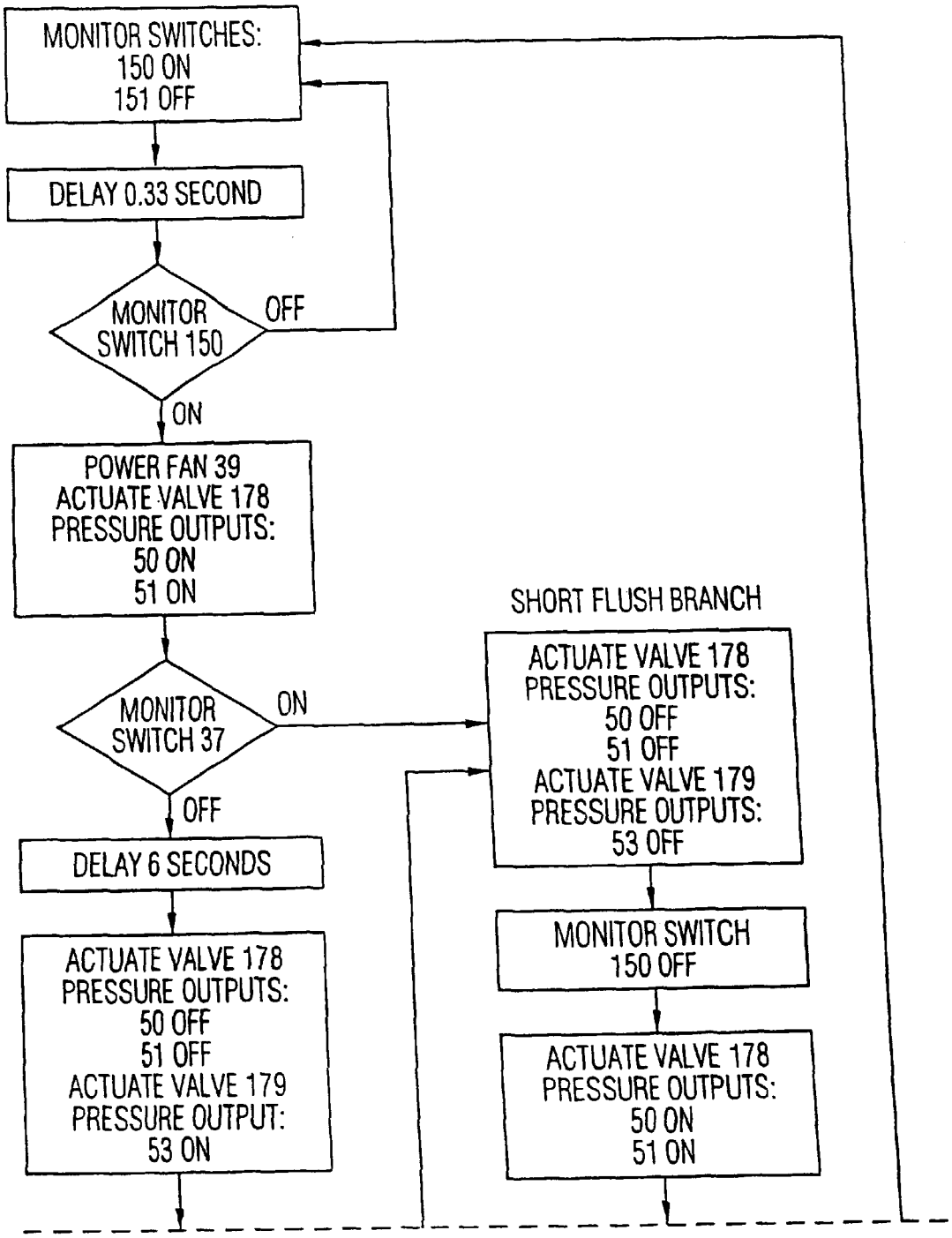
Figure 19B:
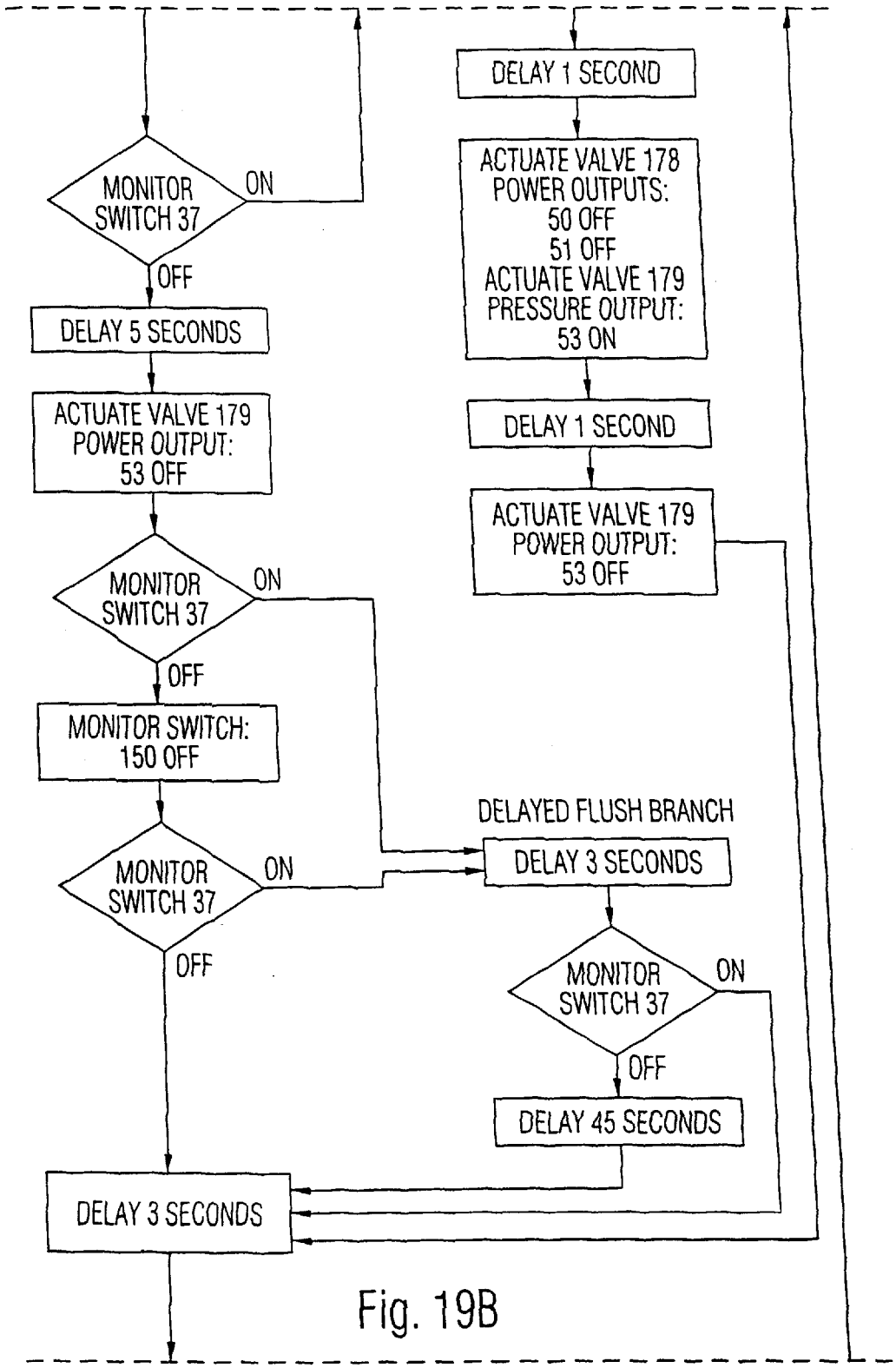
Figure 19C:
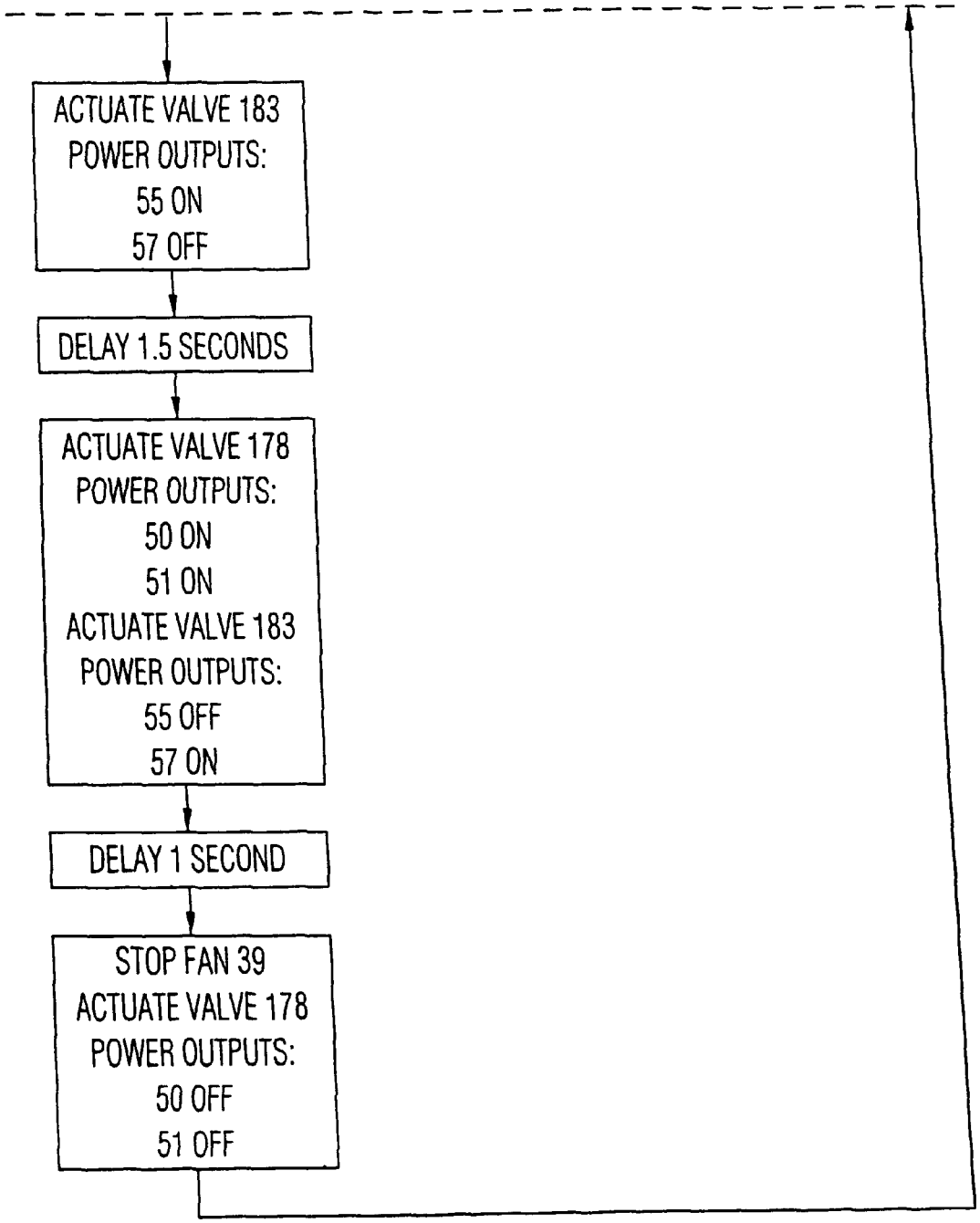

FIGS. 19A, 19B, and 19C show one control flowchart, on three drawings, of one program cycle. The program cycle shows how the toilet responses to inputs from a weight-sensing switch alone, or to inputs from the weight-sensing switch and a foot switch, that are respectively activated by a person who sits primarily to defecate or primarily to urinate.

Figure 20:
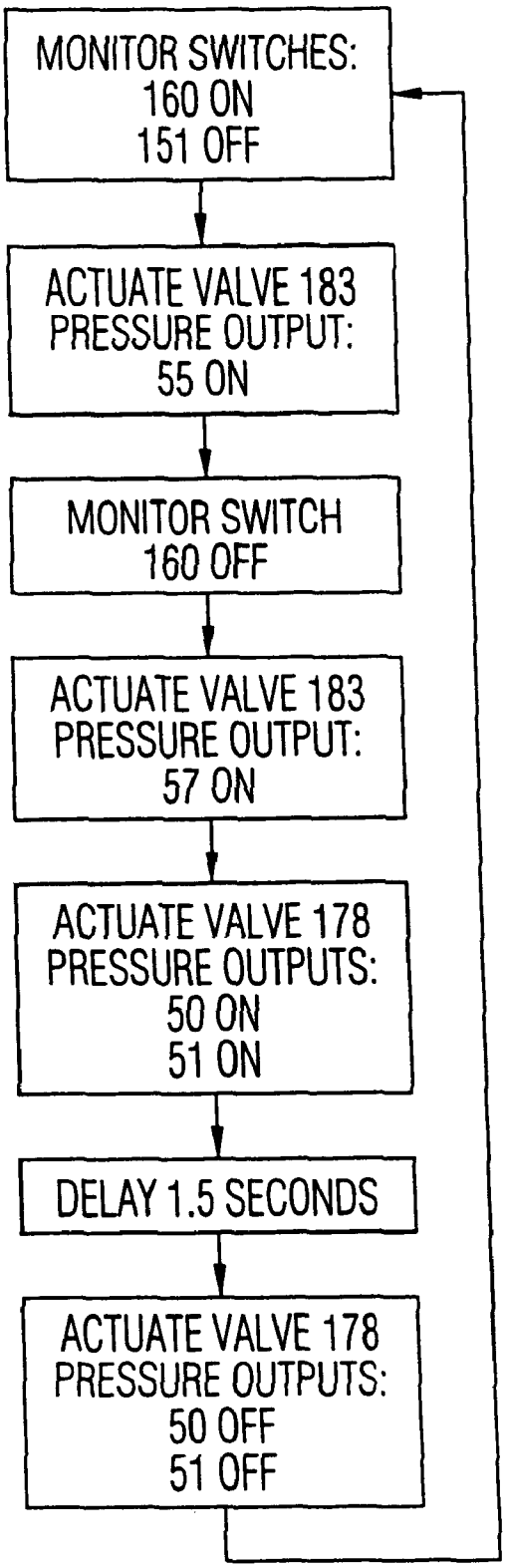

FIG. 20 shows a control flowchart for flushing a clog from an adjoining sewer pipe.

REFERENCE NUMERALS

| | |
|---|---|
| 20 | base |
| 22 | rim |
| 24 | seat |
| 25 | seat part |
| 26 | lid part |
| 27 | lid part |
| 28 | control cabinet |
| 29 | rinse plunger |
| 30 | flap |
| 31 | flush plunger |
| 32 | cup |
| 34 | shutter |
| 35 | exhaust duct |
| 36 | sewer pipe |
| 37 | foot switch |
| 38 | water tubes |
| 39 | fan |
| 40 | exhaust water seal |
| 41 | main water seal |
| 42 | splash deflector |
| 46 | control box |
| 48 | cylinder |
| 49 | valve-block |
| 50 | pressure output |
| 51 | pressure output |
| 52 | pressure input, water main |
| 53 | pressure output |
| 54 | infusion line |
| 55 | pressure output |
| 56 | floor |
| 57 | pressure output |
| 58 | first mounting flange |
| 66 | gasket |
| 67 | hinge pins |
| 68 | first shaft |
| 70 | second shaft |
| 71 | bowl |
| 72 | frame of lap assembly |
| 74 | bottom edge of cylinder |
| 75 | flap actuating arm |
| 76 | hub of lap actuating arm |
| 78 | springy plate |
| 80 | dimple |
| 82 | spring leaf |
| 84 | rivet |
| 85 | rivets |
| 86 | water level |
| 87 | screws |
| 91 | side wall of cup |
| 92 | clearance gap |
| 94 | leaf spring |
| 96 | flap opening roller |
| 98 | arm pivoting on 2d shaft |
| 99 | pin |

-continued

| | |
|---|---|
| 100 | connecting link |
| 101 | pin |
| 102 | torsion spring |
| 110 | bellows |
| 116 | water inlet to bellows |
| 118 | transfer arm |
| 120 | third shaft |
| 122 | bracket |
| 124 | fork |
| 128 | rotating arm of cup |
| 130 | roller |
| 132 | forked end of cup |
| 134 | hub of cup |
| 136 | first water jet |
| 138 | second water jet |
| 140 | third water jet |
| 142 | first area |
| 144 | second area |
| 146 | third area |
| 147 | nubbin |
| 148 | overlapping rinses |
| 149 | magnet |
| 150 | weight-sensing |
| 151 | proximity switch |
| 153 | valve |
| 154 | inlet to cylinder |
| 155 | jet of water |
| 156 | fourth water jet |
| 157 | water tube |
| 158 | fifth water jet |
| 159 | pressure output |
| 160 | manual switch |
| 161 | fan intake |
| 162 | flap fully retracted |
| 164 | cup retracted |
| 166 | inflatable part |
| 167 | waste passageway |
| 168 | garden hose |
| 170 | fully inflated |
| 172 | clog |
| 173 | space |
| 174 | aperture |
| 175 | aperture extension |
| 176 | aperture |
| 177 | aperture extension |
| 178 | valve |
| 179 | valve |
| 180 | valve |
| 181 | lid lock |
| 182 | locking arm |
| 183 | valve |
| 184 | catch |
| 186 | transitional imaginary line |
| 188 | hinge |
| 190 | water filter |
| 192 | pin |

DETAILED DESCRIPTION

Figure 1:
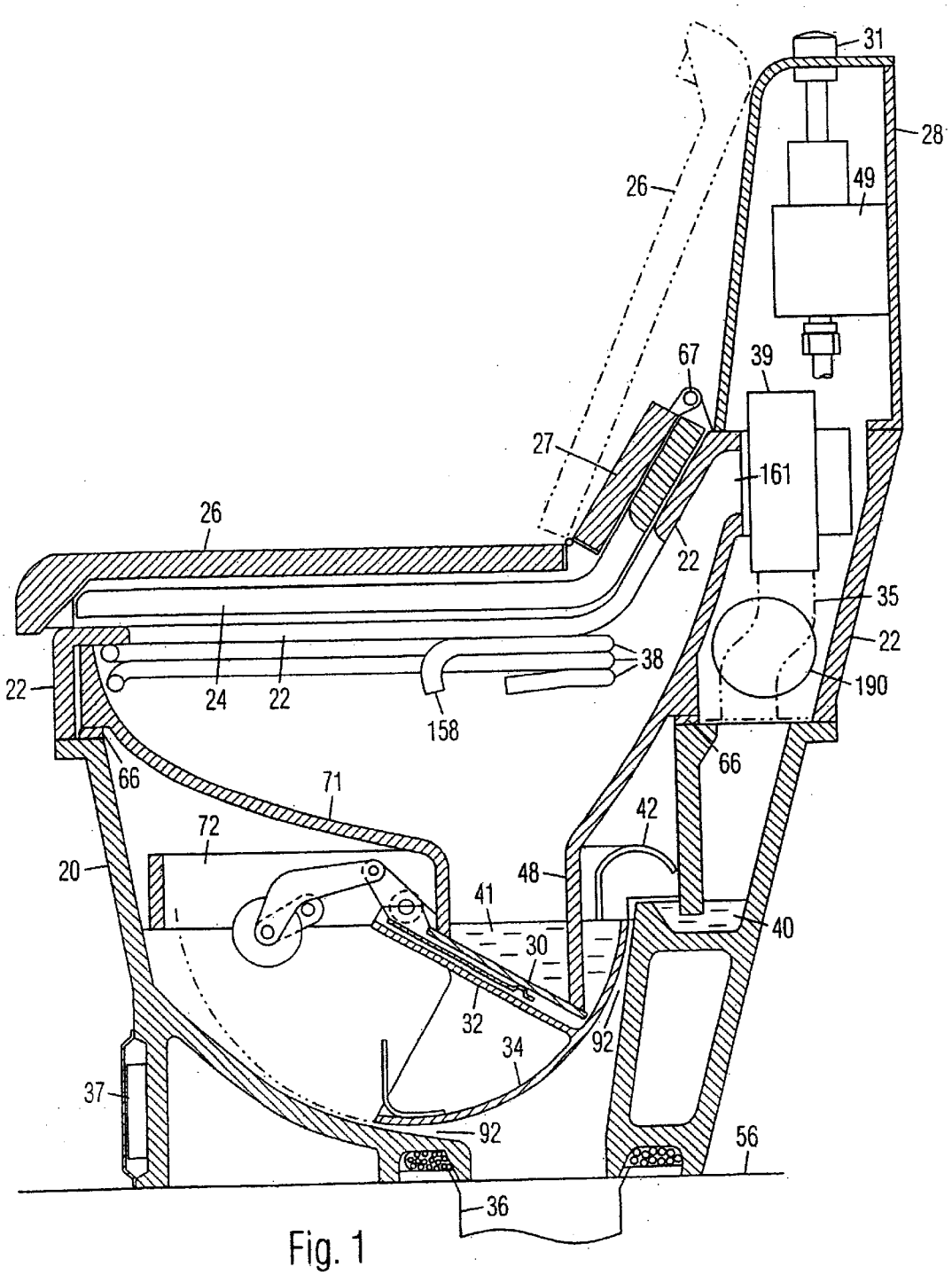
FIG. 1 shows a general view of our assembled toilet in cross section through a centerline from front to rear as viewed from right to left.
Figure 2:
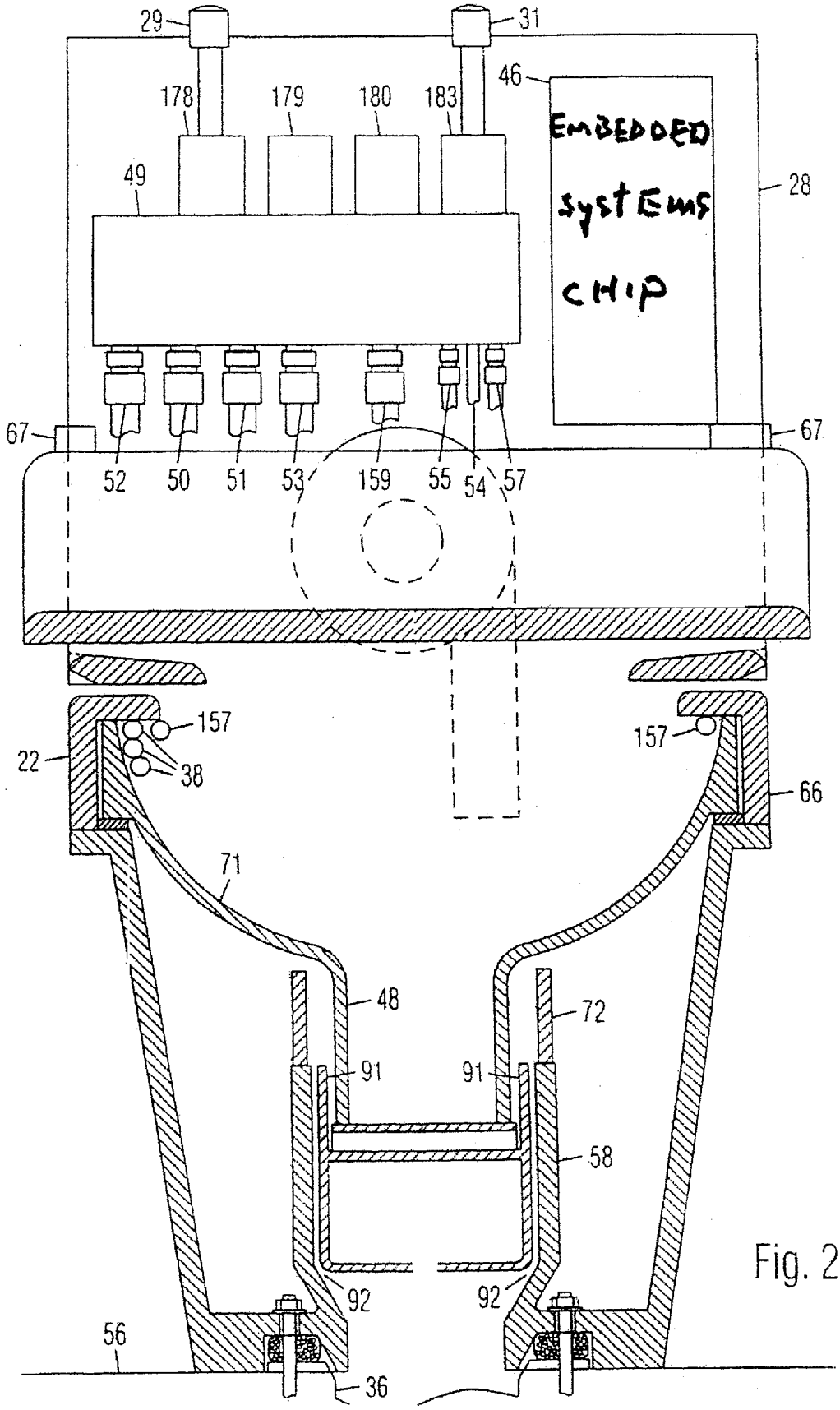
FIG. 2 shows our assembled toilet in cross section from side to side through a centerline of a cylinder extension of a bowl and a center of a sewer pipe, as viewed from front to FIG. 3 shows details of the cross section of a flap, a cup, and a flap-and-cup-actuating mechanism shown in FIG. 1.

FIGS. 1 and 2—General and Side Views

FIGS. 1 and 2 show a general assembly of the main components of our toilet in cross section as seen, respectively from a side and a front vie.

A base 20 is mounted on floor 56. An outlet of a cylinder 48 of a bowl 71 of the toilet is aligned with a sewer pipe 36. A foot switch 37 is set into a front face of base 20 between 3 and 15 centimeters above the floor 56 this is well above water or urine on the floor that can short a foot switch. A person readily can actuate our foot switch at this height with a toe when standing in front of the toilet and with a heel when seated.

Bowl 71 sits on a gasket 66 on a top edge of base 20. Rim 22 rests on a top edge of the bowl. Screws fasten rim 22 to a top edge of base 20 and pull the rim down to the base. These screws compress gasket 66 also and thereby prevent gases escaping from the base.

A hydro-mechanical flap and cup actuating module is mounted on top of mounting flanges 58 inside of the base module. A frame 72 fastens the flap-and-cup actuating module to the base module. Flap 30 is shown in the up position, closing a lower outlet of cylinder-extension 48 of the bowl. A cup 32 holds a main water seal 41. A cylindrically shaped downwardly curving extension 34 of cup 32 forms a shutter 34. Small-clearance gaps 92 exist between the base and the shutter. Similar gaps exist between the base and mounting flanges 58 and walls 91 of the cup. The clearance gaps are small enough to prevent sewer rats, cockroaches, and other creatures from entering the base from sewer 36. Base 20 encases the bowl module and the hydro-mechanical flap-and-cup actuating module within gently curving exterior surfaces.

A system 38 of three water tubes is mounted under rim 22 (FIG. 2). The water tubes, respectively, distribute pressurized water from pressure outputs 50, 51, and 53 in valve block 49 to water jets 136, 138, and 140 shown in FIG. 8.

An exhaust fan 39 is mounted between the bowl and the rim, at the rear of an odor intake 161. The fan draws air and the smells of waste from under a sitting person and discharges them through an exhaust duct 35 into a cavity in the rear of base module 20. When the fan starts, it expels the odor and the water in water seal 40 past splash deflector 42 into the sewer pipe. When the fan comes to a stop, a gas-sealing level of water automatically restores the water seal as described below.

Seat part 25 and lid part 27 pivot on a pair of hinge pins 67 on top of rim 22.

Control cabinet 28 is bolted to the top of the rear of rim 22. FIG. 2 shows the control cabinet housing a valve block 49 and a box 46. Box 46 is made water tight for safety as it contains an electrical power supply (not shown) and an electronic controls (not shown.). The electronic control is an embedded systems chip (ESC). Electricity powers the ESC, which, in turn, operates the automated features of the toilet, as described below.

A conventional water main supplies water under pressure via in-line water filter 190 and water input 52 to water block 49. The valve block houses four valves, 178, 179, 180, and 183. The valves operate infusion line 54 and six pressure outputs, 50, 51, 53, 55, 57, and 159. When one of the valves opens, main water under pressure flows through at least one of the six pressure outputs. When the valve closes, no water flows.

Figure 8:
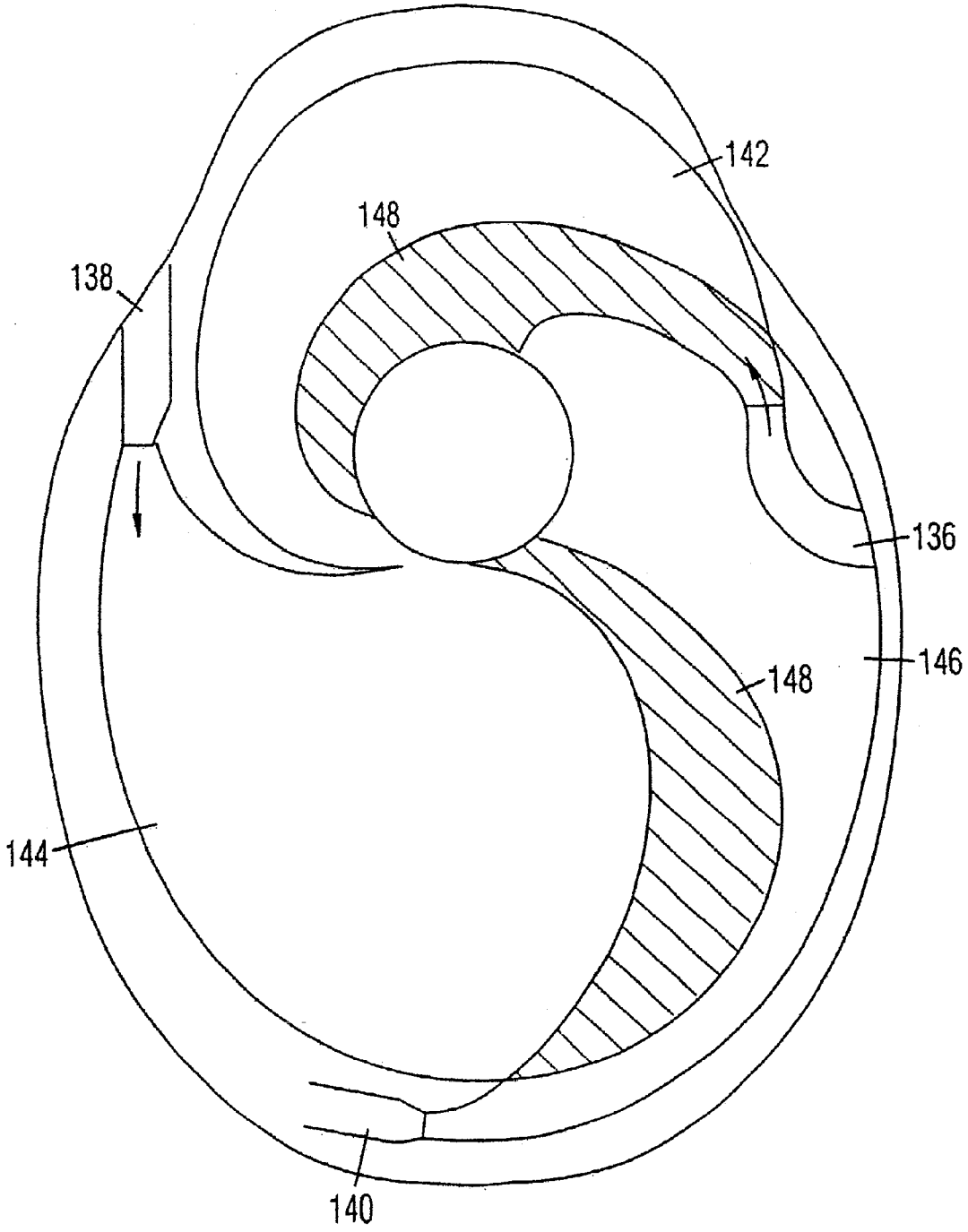
FIG. 8 shows a toilet bowl from above and jet outlets of water tubes and areas that the jet outlets rinse. The water tubes are also shown in FIGS. 1 and 2.

Pressure outputs 50 and 51, respectively, supply pressurized water via two of three water tubes 38, shown under rim 22, to water jets 138 and 136, shown in FIG. 8. Pressure output 53 supplies pressurized water via the third of the three water tubes 38 to a water jet 140, shown in FIG. 8.

Figure 14:
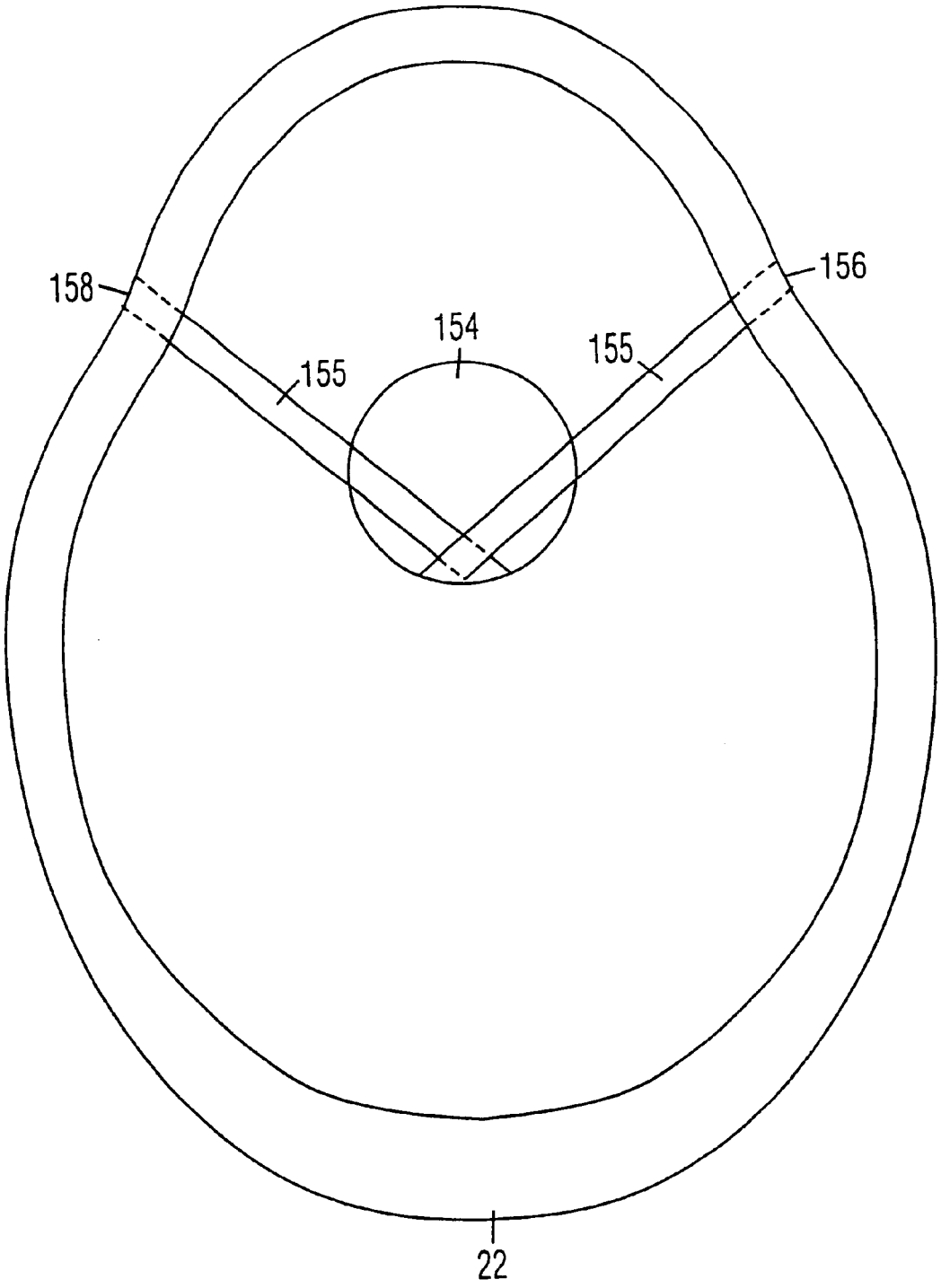
FIG. 14 shows a toilet-bowl rim and outlet viewed from above. Water jets under the rim are shown jetting water into the outlet of the bowl.
Figure 15:
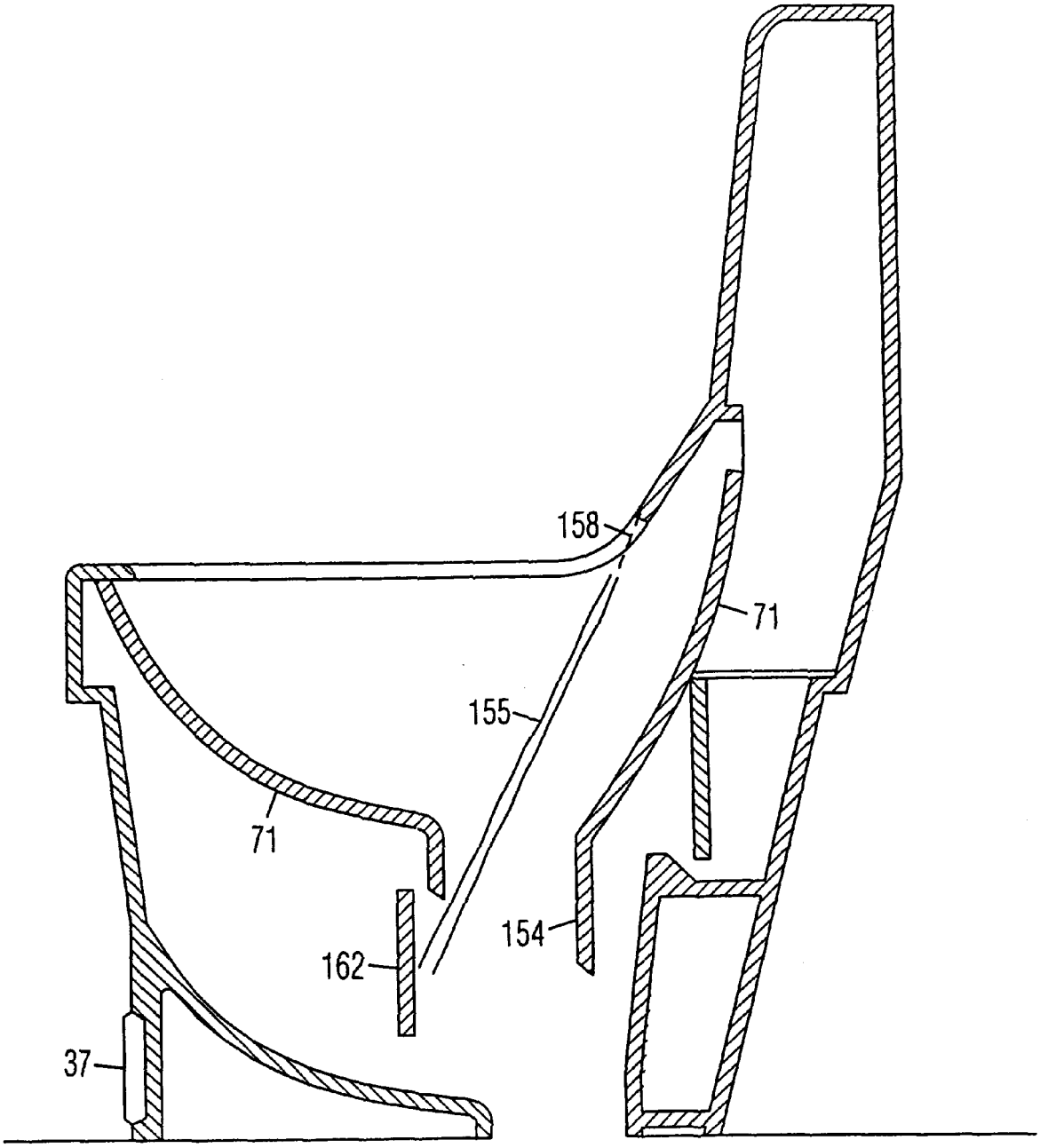
FIG. 15 shows a cross section view of the toilet of FIG. 14 from right to left. This cross section shows water issuing from the water jet shown under the rim on the left in FIG. 14.

Pressure output 159 supplies water, under pressure, via water tubes 157, shown in FIG. 2, to water jet 158, shown in FIGS. 1 and 15 and to water jet 156, shown in FIG. 14.

Figure 6:
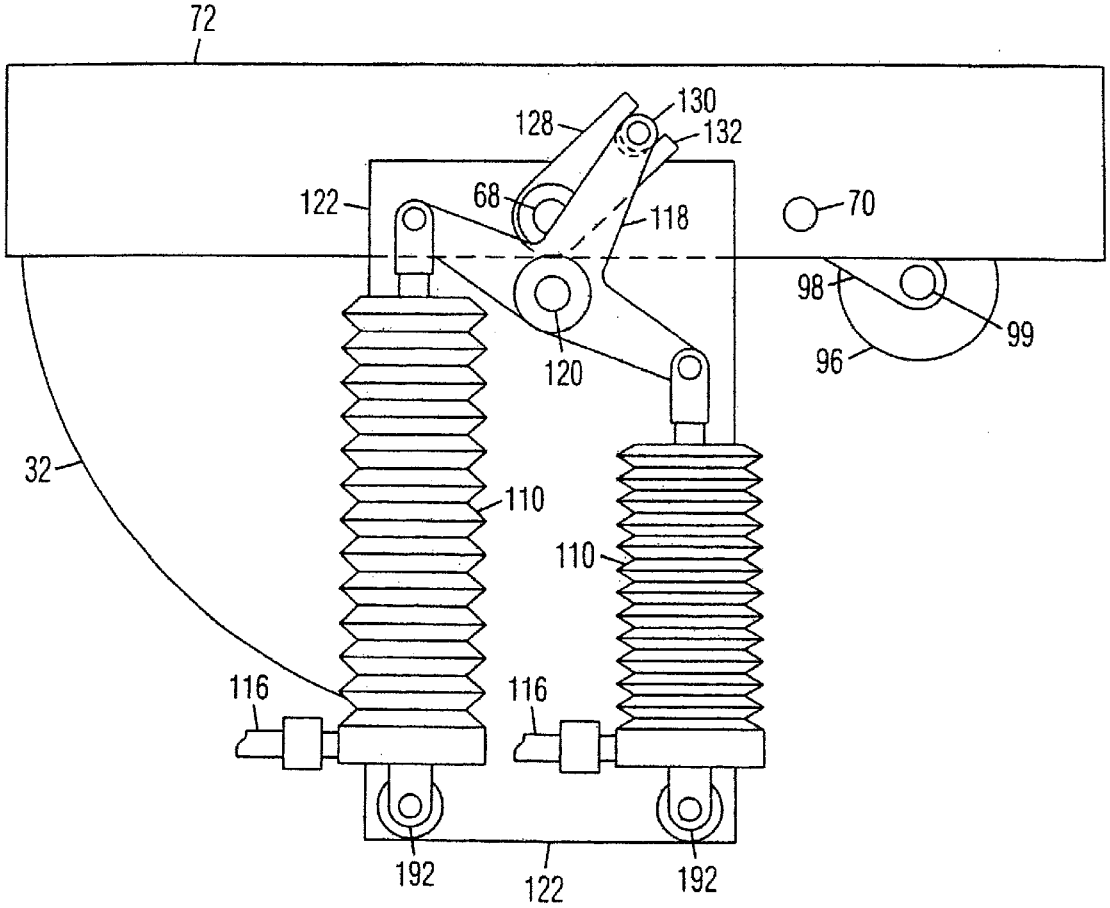
FIG. 6 shows a view from left to right of further details of the flap-and-cup-actuating mechanism shown in FIG. 5.

Pressure outputs 55 and 57 supply pressurized water, by conduits (not shown), via water inlet to a pair of hydraulically-urged bellows 110, shown in FIG. 6.

Infusion line 54 supplies water via a conduit (not shown) to renew an exhaust water seal 40 located in base 20, as shown in FIG. 1.

Figure 3:
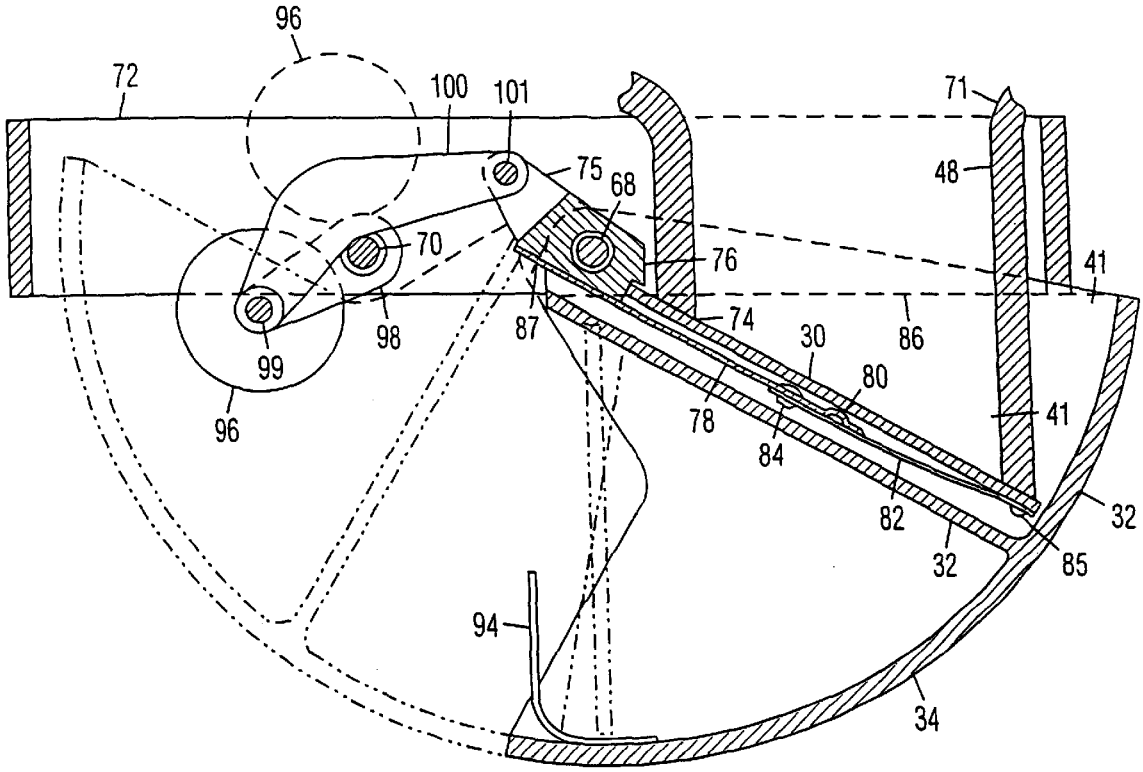
Figure 5:
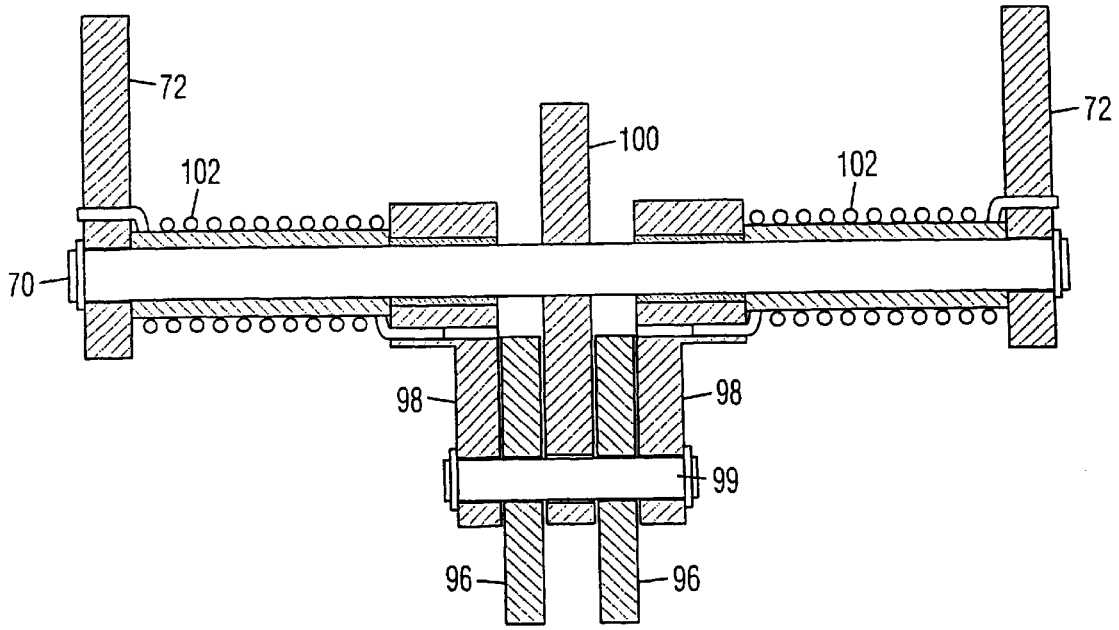
FIG. 5 shows a cross section from front to rear, through a shaft and a torsion spring and further details of the Hap-and-cup-actuating mechanism.

Flap and Cup Mechanism—FIGS. 1, 3, 5

FIG. 3 shows, in cross section, details of a hydro-mechanical mechanism that links the opening and closing of the flap and the cup, shown in FIG. 1 (the mechanism is also shown in FIG. 5 which is a cross section in line with second shaft 70.). The flap and cup are shown in the closed (up) position with solid lines and in the open (down) position with phantom lines. To open, the flap and the cup rotate clockwise. To open fully, the cup rotates 90°. To open fully, the flap rotates 60°. These rotations are linked mechanically so that the opening of the flap and cup overlap. While the flap is still closed and retaining waste in the toilet bowl, the cup opens 55°. Then, during the last 35° of the opening rotation of the cup, the flap rotates 60° to its fully open position, vertically down. The following describes in detail the mechanical linkage mechanism and how its parts move when opening and closing the flap and cup:

The flap and cup are both mounted on and rotate on first shaft 68. Flap 30 is attached to a hub 76 of a flap-actuating arm 75.

The flap is shown held up (closed) by the flap actuating arm and a connecting link 100. The flap actuating arm and the connecting link are held together by pin 101. Pin 99 secures the other end of connecting link 100 to a pair of pivoting arms 98. Thus, rotation of pivoting arms 98 around shaft 70 opens or closes the flap by pushing or pulling connecting link 100, which in turn pushes or pulls flap-actuating arm 75. Pivoting arms 98, shown with phantom lines, are at the end of their counterclockwise this position by the torque of torsion spring 102, shown only in FIG. 5.

When the cup opens, the flap opens as follows. A leaf spring 94 is mounted on shutter extension 34 of the cup. When the cup has rotated open 55°, the leaf spring contacts and pushes rollers 96, which are held by pin 99. Elasticity of the leaf spring softens the impact of the leaf spring on the rollers. During the rest of its opening rotation the cup forces the rollers upward and, by pushing connecting link 100, opens the flap.

Figure 4:
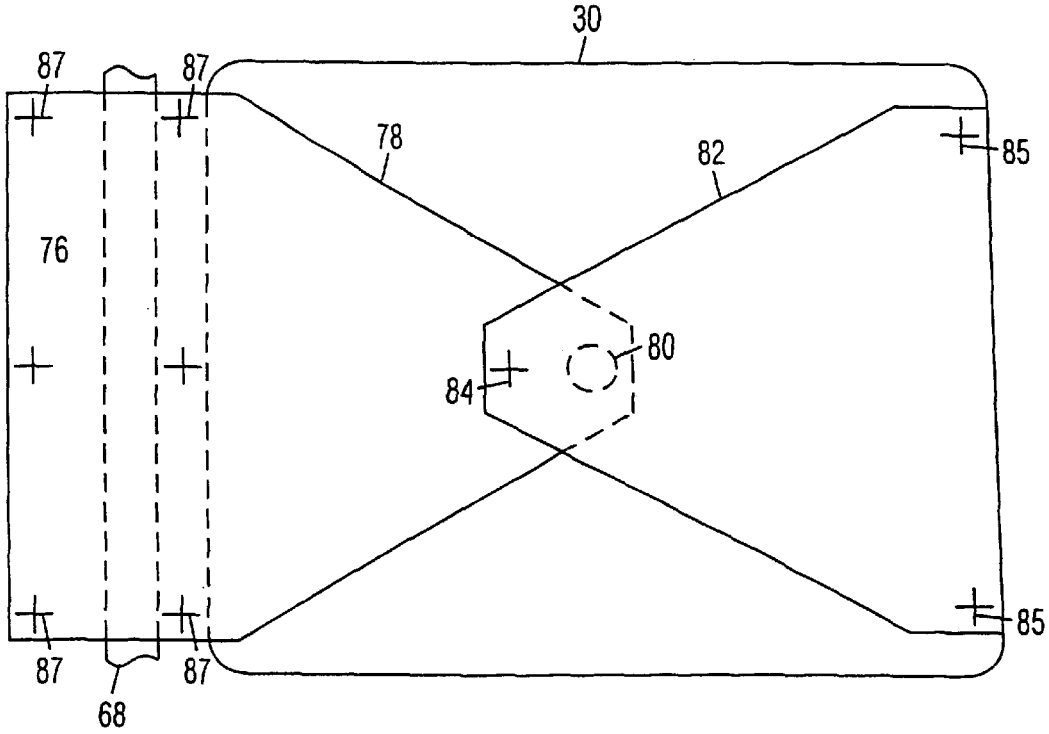
FIG. 4 shows the underside of the flap of FIG. 3.

Tilting Mechanism That Seats Flap Against Cylinder—FIG. 4

This figure shows from below the attachment of the flap to hub 76 of flap-actuating arm 75. An arm, springy plate 78, is bolted to the bottom surface of the flap-actuating arm by screws 87. The springy plate deflects to close the flap.

FIG. 4 also shows how spring leaf 82 and rivets 85 and 84 secure flap 30. Since the spring leaf is flexible, it permits the flap to tilt. A dimple 80 with a spherical top surface is pressed into the bottom of springy plate 78. The springy plate pushes the top of the dimple against the bottom of the flap in line with the geometrical center of a bottom edge 74 of cylinder 48 (FIG. 3). Thus, the flap, tilting on the top of the dimple, aligns more closely against the bottom of cylinder 48.

Spring—FIG. 5

Release of torque of torsion spring 102 rotates arm 98 counterclockwise on shaft 70 to close the flap.

Figure 7:
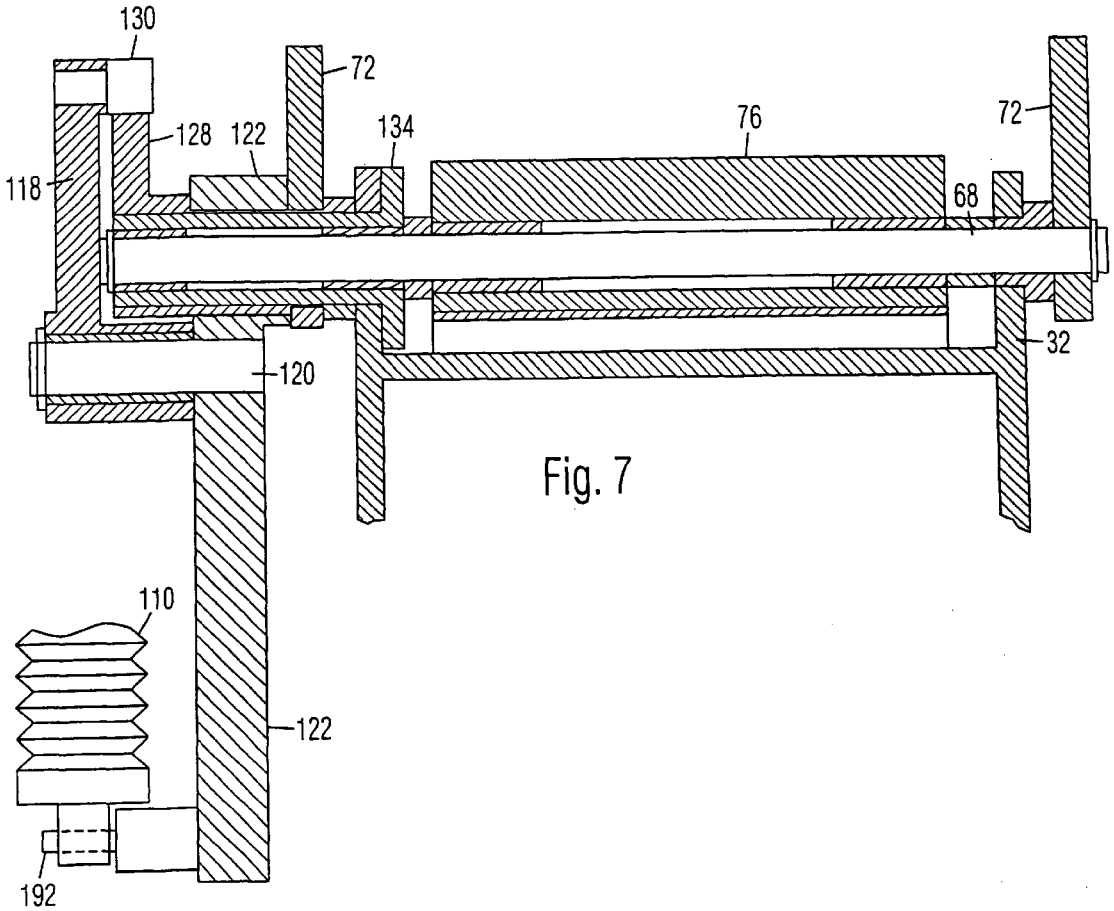
FIG. 7 shows a cross section, viewed from front to rear, through the shaft used in the mechanism shown in FIG. 3

Flap-and-Cup Actuating Mechanism—FIGS. 6 and 7

FIG. 6 is a detailed side view of the hydro-mechanical flap-and-cup actuating module. FIG. 7 is a cross section of the flap-and-cup mechanical actuating module, from the front. FIG. 7 also shows rotating arm 128 attached to a hub 134. Cup 32 is mounted on hub 134—this hub is shown only in FIG. 7.

Returning to FIG. 2, water under pressure powers the mechanical linkage that opens and closes the flap and cup as follow:

Pressure outputs 55 and 57 of valve block 49 connect to water inlets 116 (FIG. 6) of a pair of bellows 110, which are mounted on bracket 122 that is bolted to frame 72. The bracket 122 as shown in FIG. 7.

When water compresses one bellows, it expands the other one and vice-versa. Alternating expansion and compression rotates transfer arm 118. The transfer arm pivots on a third shaft 120, which extends from a bracket 122 that is mounted on the side of frame 72.

A roller 130 is mounted on an upper end of transfer arm 118. Roller 130 engages fork end 132 on the upper end of rotating arm 128. The roller allows arms 118 and 128 to rotate on shafts 68 and 120, respectively, without the arms locking.

Transfer arm 118 pivots on a third shaft 120, which extends from a bracket 122 that is mounted on the side of frame 72. Transfer arm 118 rotates arm 128 through a 90° arc to open and close the flap and the cup. Arm 128 is shown is the position in which it fully closes the flap and cup.

As mentioned above, a flap-tilting-mechanism causes the closed flap to fit closely against a bottom outlet of a cylinder. The fit of the flap against the cylinder is designed there is only clean water in the bowl, the cup can create a clean water seal between a sewer pipe and the bowl as described below. The closed flap can retain a considerable amount of waste mass in the bowl while permitting a small amount of waste in suspension to seep into the cup.

FIG. 8—Rinsing Patterns in Toilet Bowl

FIG. 8 is a view of the toilet bowl from above. It shows the position under a rim of more commonly used water jets, first jet 136, a second jet 138, and third jet 140. It also shows corresponding areas of the bowl that each water jet respectively rinses, first area 142, second area 144, and third area 146. Parallel lines 148 show areas rinsed by two water jets.

Figure 9:
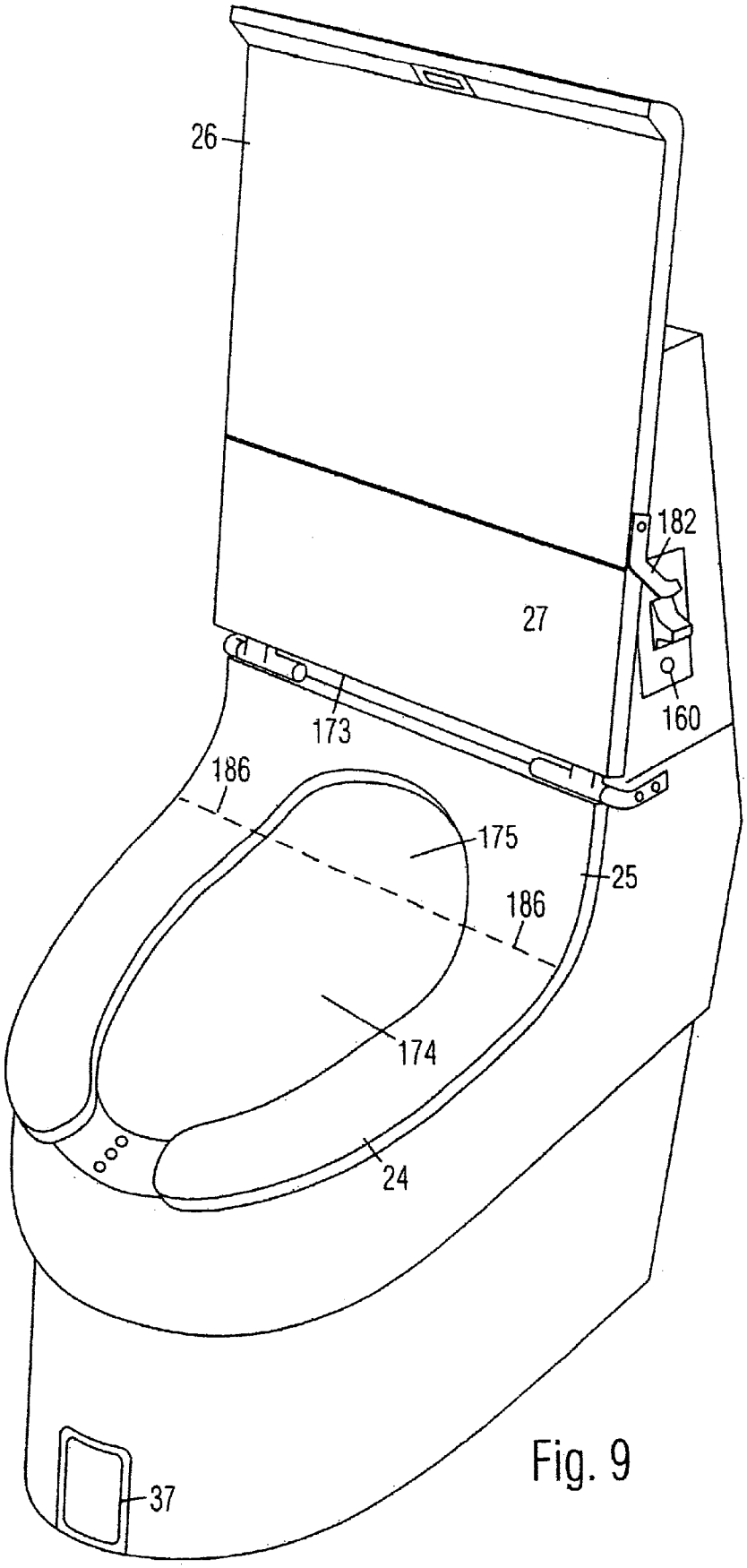
FIG. 9 shows the toilet with a lid opened vertically, a seat lowered, and an aperture within the seat.

FIG. 9—Toilet Readied For Defecation

FIG. 9 shows the toilet with the seat 24 and 25 in their closed (down) position and lid parts 26 and 27 in their fully open (vertically up) position. It shows a two-part aperture 174 and 175. The seat outlines the two part aperture.

Figure 10:
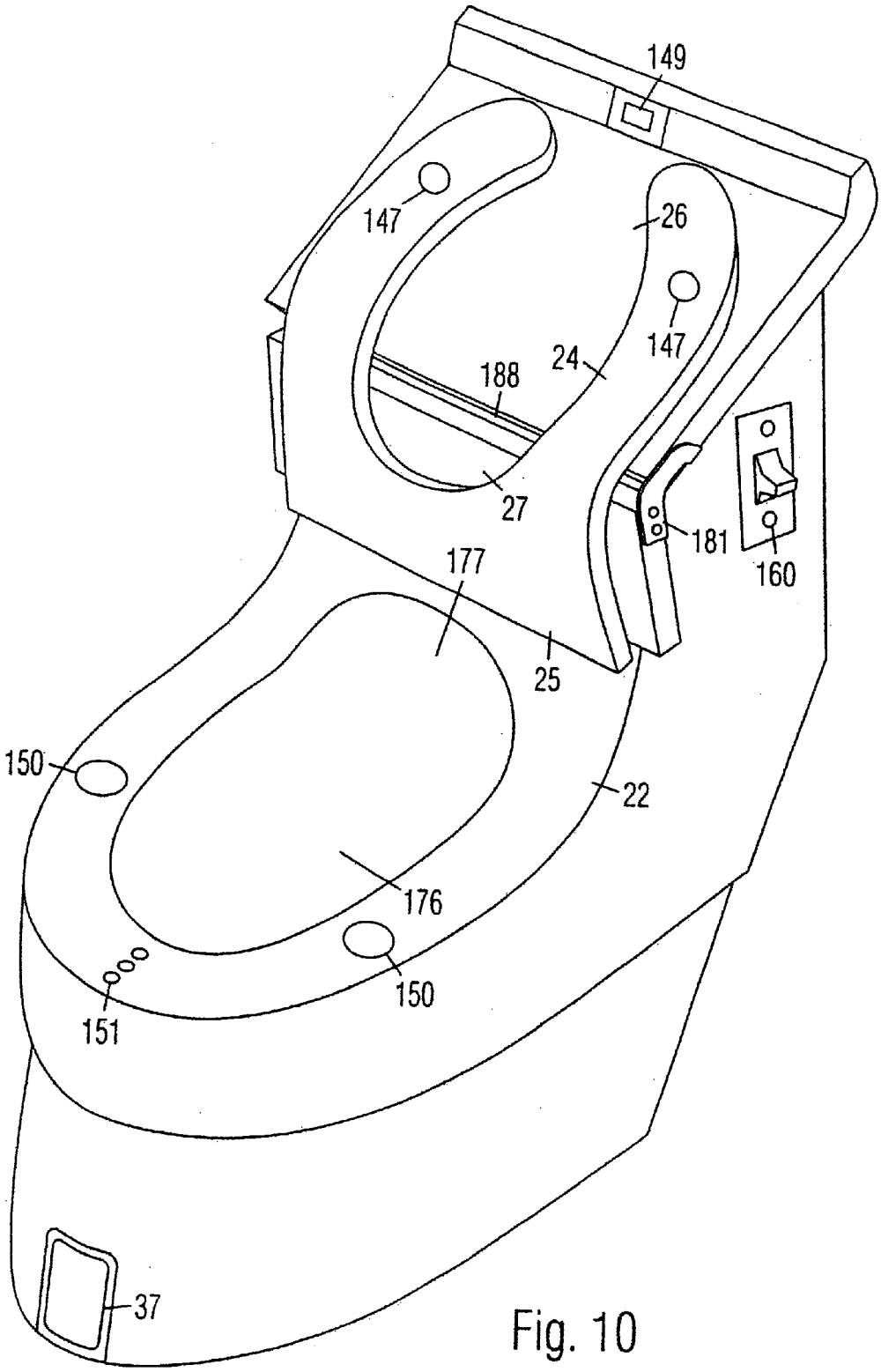
FIG. 10 shows, from above, a view of the toilet with the lid and seat raised and a rim exposed.

FIG. 10—Toilet Readied For Standee Urination

This figure shows seat 24 and seat part 25 pivoted up as a unit for those who stand to urinate. It also shows parts 26 and 27 of the lid articulated around two sets of hinges to a raised position. Lid part 27 is hinged upward on pins 67 (shown in FIGS. 1 and 2 but not in FIG. 10.). Lid part 26 is shown rotated partially upward on hinge 188, shown in more detail in FIGS. 13A and 13B. The two lid parts are locked together by lid lock 181, shown in more detail in FIGS. 13A, 13B, and 13C.

FIG. 10 also shows the lid doubly articulated to accommodate the configuration of the seat, when the seat is raised by a person who stands to urinate. The lid, in the position shown, stays raised gravitationally because its center of gravity is behind hinge 188. For reasons to be described later, this is the preferred disposition of the seat for a person who is standing to urinate.

FIG. 10 also shows a pair of weight-sensing switches 150 in rim 22 and a pair of nubbins 147 in seat part 24. It also shows a foot switch 37, a manual on-and-off switch 160, a magnet 149 in the lid, and a proximity switch 151 in rim 22.

The weight of a person seating on the seat activates one or both weight-sensing switches. Activation of these devices has operational consequences to be described below.

Figure 11:
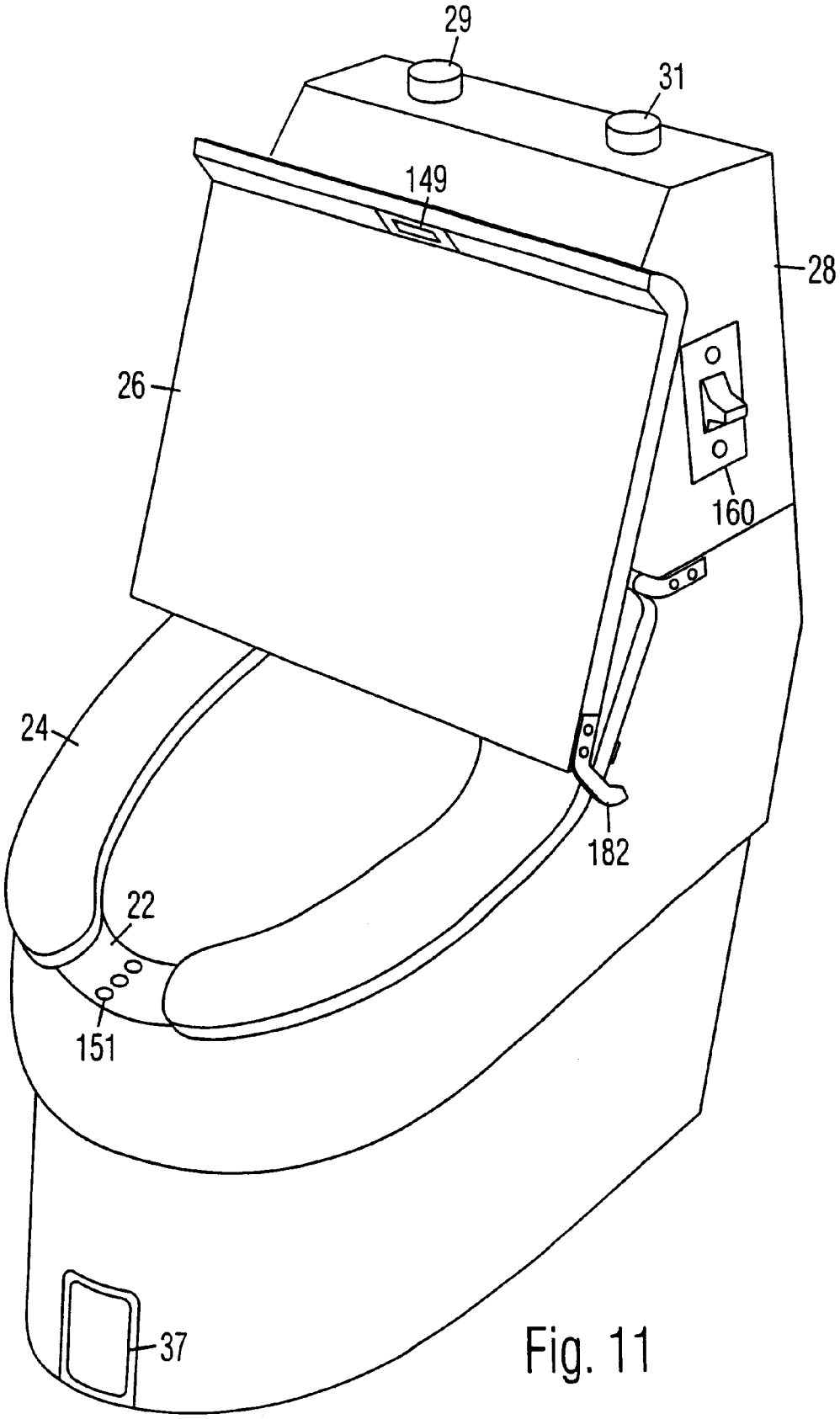
FIG. 11 shows an external view of the rim,and the seat, the lid partially closed, and a lid lock.
Figure 12:
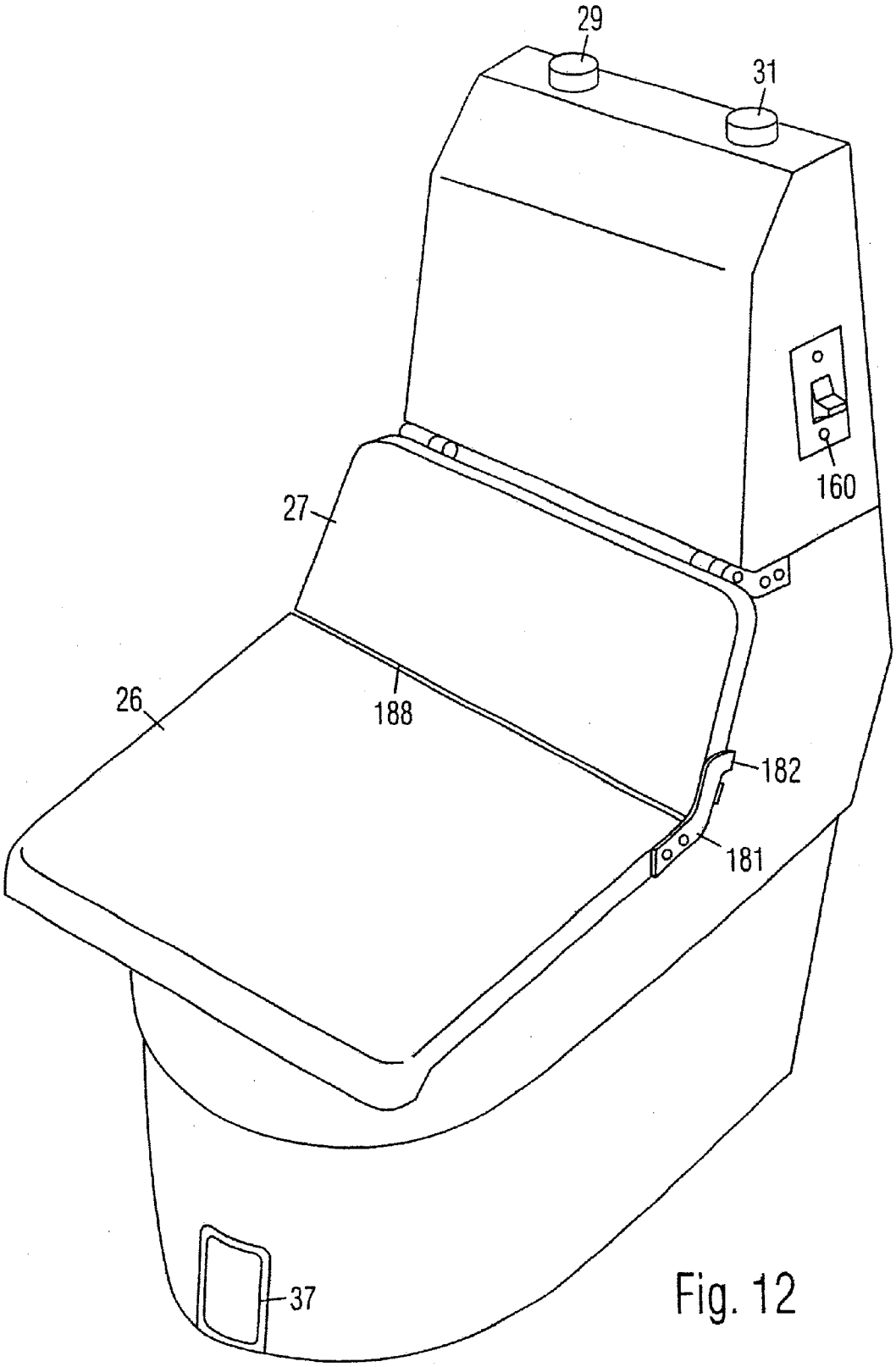
FIG. 12 shows the toilet lid fully closed.

The lid has the following four positions:

1. Fully down, as shown in FIG. 12,
2. Fully up, as shown in FIG. 9,
3. Articulated, as shown in FIG. 10, to conform to the shape of the seat, which is angular, when the seat is raised by a person who stands to urinate, and
4. Articulated as shown in FIG. 11. This articulation centers, or helps seat, children and small people closer to the steepest and deepest part of the bowl.

The toilet can accommodate the following persons:

1. Those who stand to urinate,
2. Those who defecate, and
3. Those who sit to urinate.

It performs these functions as follows:

Rinsing and Flushing—Standee Urinators—FIGS. 1–3, 5, 8, and 10.

Some people sit to urinate and some people stand to urinate. Assume a person stands to urinate. They first raise the lid. If courteous, the person raises the seat to avoid wetting it.

Normally, cup 32 is in its up position and it is full of water (FIGS. 1 and 3). The cup embraces the bottom of cylinder 48 and flap 30. This water forms main water seal 41. A person looking into the toilet can see a relatively small amount of clean main water, the water seal, at the bottom of the cylinder. Thus, it is much easier for a user to urinate silently by avoiding the water. Hence, a person at the door of the water closet or bathroom does not hear the user urinating.

Normally, the wall of the cylinder and the bowl from the water seal to the rim of the bowl are dry. Thus, before rinsing occurs, urine can hit and stick to the bowl above the water seal. Consequently, the bowl and cylinder need rinsing as follows:

The person briefly actuates foot-pedal 37 shown in FIGS. 2 and 10, (The person can readily reach our foot switch, with a toe when standing and with a heel when seated, because it is conveniently located at the front of the body of the toilet at foot level. Wall mounted foot switches found in public bathrooms are difficult to reach. Some people with back disorders experience pain when they lean over to activate a tank-mounted lever.)

Figure 18:
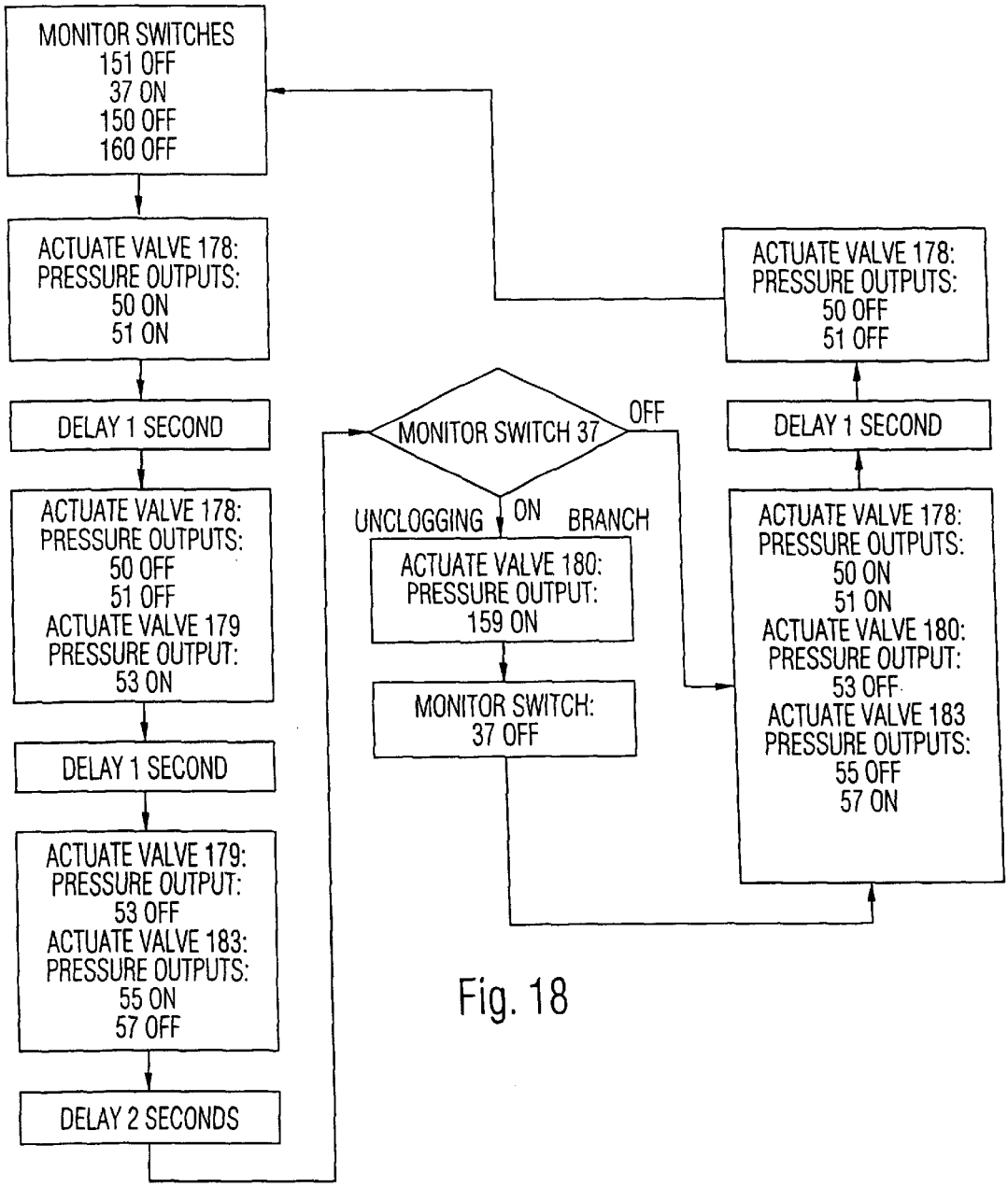
FIG. 18 shows a control flowchart for rinsing and flushing in response to foot switch inputs from a person who stands to urinate or wishes to unclog a cylinder inlet.

In response to an electric signal from the foot-pedal, an embedded system chip in box 46 rinses and flushes the toilet by using the control logic shown in FIG. 18. In this mode of usage switches 150, 151, and 160 are turned off. Foot switch 37 then turns on.

This action opens valve 178. This action causes pressurized water to flow for one second through water outputs 50 and 51 (FIG. 2) and water jets 136 and 138 (FIG. 8). Consequently, water jets 136 and 138, respectively, rinse areas 142 and 144, shown in FIG. 8. There is a one-second delay. The above flow and rinsing can continue for one second.

Valve 178 closes. This causes pressure outputs 50 and 51 to turn off and, thus, causes water jets 136 and 138 to stop rinsing the bowl. Simultaneously, valve 179 opens for one second. Pressure output 53 automatically causes water jet 140 to jet rinse the remainder of the bowl, area 146, for one second, while valve 179 stays open. (Areas 148 of the bowl are rinsed twice as water jets 136 and 140, respectively, rinse more of the front and back of the bowl than water jet 136 ). Consequently, all of the bowl gets a thorough rinse. Urine mixed with rinse water temporarily accumulates in the cylinder and bowl.

Valve 179 closes. Simultaneous actuation of valve 183 turns pressure output 57 off and pressure outputs 55 on, for two seconds. This action by valve 183 causes bellows 110 to urge the hydro-mechanical flap-and-cup actuating linkage mechanism, shown in FIG. 3, to open for two seconds cup 32 and flap 30 (FIGS. 5, 6, and 7). The accumulated rinse water and urine flush by falling of their own weight into sewer pipe 36.

Then, the controls monitor determines whether foot switch 37 is on or off. If the switch is on that indicates that the person wants to initiate flow 155 of water from water jets 156 and 158 to break up a clog obstructing the inlet to the cylinder 8 (FIG. 14). Breaking such a clog will be described and discussed below under Unclogging Branch of the flow chart of FIG. 18.

If foot switch 37 is off, the toilet automatically flushes according to a Short Flush Branch of the flowchart shown in FIG. 19. The Short Flush Branch will be described and discussed in detail below as part of the control functions that can occur when a person sits on the toilet.

In summary, the Short Flush Branch automatically flushes the toilet as follows:

The flap and cup close. Clean main water expelled from collapsing bellows 110 (FIG. 6), returns to valve block 49 (FIG. 2), from which it flows via infusion line 54 to renew exhausted water seal 40 (FIG. 1) with clean water. Water jets 136 and 138 (FIG. 8) briefly infuse clean rinse water into the bowl and cylinder and re-creates main water seal (FIGS. 1 and 3) as follows to complete the cycle:

The springy and dimpled flap-tilting-mechanism mentioned above closes flap 30 snuggly against a bottom outlet of a cylinder. The fit of the flap against the cylinder is designed to permit water to seep into and to fill cup 32, which is closed underneath the flap. Thus, clean water in the cup can re-create a clean water seal between the toilet and the sewer pipe. Thus when there is no urine in the bowl and the water that infuses the bowl is clean, the water that collects above the closed flap and in the closed cup creates a clean water seal.

Our toilet thoroughly rinses and flushes urine, in about two seconds, with between 300 and 400 milliliters of water. Conventional domestic, commercial, and public toilets need from six to twelve or more liters.

Rinsing and Flushing Stools—FIGS. 1, 2, 6, 8–11, and 19

To clarify what follows it helps to realize that the contents of the colon and rectum of the human intestine vary widely from one person to another. For example many normal people produce a combination of gas under pressure and soft feces. As soon as they sit to defecate the pressurized gas causes feces widely to scatter, down into water, and out and up to smear the wall of the bowl; Conventional toilets are particularly poor at rinsing such smears. However, most people sit for seconds to minutes before actually defecating. Our toilet is programmed to accommodate such extremes.

A person sitting to use the toilet to defecate or to urinate causes the toilet to act in a variety of ways in response to electronic controls. For the sake of clarity, the following describes first what a person unskilled in the art of electronic controls can readily understand. Then, the functions of the controls shown in FIGS. 19A, 19B, and 19C will be described in more detail.

Assume a person who wishes to defecate finds the seat and lid raised (FIG. 10). The person lowers the seat, raises the lid to form a backrest (FIG. 9), and sits down. The weight of the person causing the following toilet operations to occur.

Their weight presses nubbins 147 on the lid against a pair of weight-sensing switches 150 in the rim. One or both switches 150 send a signal to the electronic controls (FIG. 19). Fan 39 automatically sucks air from the bowl via a fan intake 161 located between rim 22 and bowl 71, as shown in FIG. 1. The fan forces air against the water of exhaust seal 40. The air forces the water via a space between base module 20 and the bowl module and, thence, via space 92 into sewer pipe 36.

Water jets 136, 138 and 140 (FIG. 8) promptly and automatically rinse their respective areas of the bowl. Water jets 136 and 138 rinse for about six and water jet 140 for about five seconds considerably longer than for urine alone. Consequently this rinse is considerably more powerful and widespread than the rinse described above for those who stand to urinate. Accordingly, stools spattered widely against the bowl, by those who expel soft stools and gas under pressure, are readily rinsed into the lower bowl where it accumulates.

Assume that the sitting person is slower to defecate than the extreme example related above. In due course, when the person defecates, their stools fall into accumulated rinse water that is deep enough to prevent smearing of the cylinder and the bottom of the bowl. Furthermore, the accumulated water is also deep enough to cover the stools and, hence, further helps the fan to prevent stool odors from rising into the bathroom. In places, especially in Japan, it is customary to confine each toilet to very small closet so that the window can be left open in the coldest weather to help prevent odors permeating the rest of the house without cooling it excessively. Our toilet automatically exhausts fecal odors to a sewer pipe. Further, in Japan, our toilet can permit people to close the window and reduce the cost of heating the rest of the house.

The person wipes and then stands up. The flap and cup (FIGS. 1 and 2) promptly and automatically open. The contents of the bowl; feces, toilet tissue, other solid waste, and soiled rinse water promptly fall gravitationally into the sewer pipe. Then, the flap and cup promptly close, first the flap and then the cup. Water valve 183 rinses the bowl briefly with clean water to recreate main water seal 41. The fan stops. Clean water from bellows 110 (FIG. 6) flows from water line 54, shown in FIG. 2, to renew exhausted water seal 40 (FIG. 1). The following describes how our toilet recreates clean water seal 40 after flushing solid waste:

As mentioned above, when it is closed, the flap retains a considerable amount of solids, feces, toilet tissue, etc., in the bowl and permits a small amount of fecal and other solid waste particles to seep in suspension into the closed cup. When a user stands, the cup automatically opens vertically down for one second. This rapid downward movement of the cup has two effects; (1) it agitates the suspension in the cup, and (2) it promptly causes the agitated fecal particles to fall gravitationally into a sewer pipe. Thus, waste matter in suspension has little opportunity to sediment or to stick to the cup. Consequently, water output 54 can fill the cup with clean rinse water to recreate a clean water seal 41.

However, many users are in the habit of wiping while standing. Such users have two choices for giving themselves time to wipe before flushing occurs. They can actuate the foot switch before they stand, or during the first three seconds or so after standing up. In both cases actuating the foot switch delays flushing for about forty-five seconds—long enough for most people to wipe. Accordingly, with this option people who stand to wipe need not prematurely face a flushed bowl like they do when they stand up from a conventional automatically flushing toilet intending to wipe.

Furthermore, should the person finish wiping before the above-delayed automatic flush occurs, they can, if they desire, cause immediate flushing by actuating the foot switch once more.

Description Of Flowchart—FIGS. 19A, 19B, and 19C

FIGS. 19A, 19B, and 19C show a flowchart that, for clarity, is spread over three pages. This flowchart shows the functions of the controls that a person uses when sitting to defecate or to urinate, when standing to urinate, or using the toilet to purge itself free of a clog that obstructs the inlet to the cylinder. The latter two uses of the flowchart will be described and discussed later.

To start the cycle that serves a person sitting to defecate or to urinate, the lid must be open. When the lid opens, the proximity switch turns off. The person sits. The weight of the person turns weight-sensing switch 150 on.

A delay of 0.33 second follows activation of the weight-sensing switch. At the end of the delay, the status of the weight-sensing switch is monitored. If someone merely drops the seat without sitting on the seat, the weight-sensing switch activates for a moment. However, if the above monitoring finds the switch off, the controls return to the starting point of the cycle. By returning to the starting point the off condition of the switch prevents the cycle continuing and, thus, prevents inadvertent squandering of water.

If switch 150 says on, exhaust fan 39 turns on. Simultaneously, valve 178 opens and, thus, sends pressurized main water through pressure outputs 50 and 51 to the bowl via water jets 136 and 138.

If, at this point, the person sitting solely to urinate wishes to conserve water they briefly activate foot switch 37. This activation diverts the cycle to the Short Flush Branch of the flow chart, which has been mentioned above in the description of FIG. 18 and will be described later.

If foot switch 37 is off, the bowl continues to receive water for six seconds. After the six seconds, valve 178 closes pressure outputs 50 and 51. Simultaneously, valve 179 opens. This causes pressure output 53 to send water to the bowl via water jet 140.

While pressure output 53 is on, the status of foot switch 37 is monitored once more. The person can still stop the flow of water by briefly stepping on the foot switch. Doing this will direct the cycle to the Short Flush Branch mentioned above and described below.

If switch 37 is off, water continues to enter the bowl through water jet 140 for five seconds. Then, valve 179 turns off, and water stops entering the bowl.

At this point, a person who wishes to stand to wipe can delay flushing to give themselves time to wipe by activating foot switch 37 briefly. This activation causes the program to proceed to the Delayed Flush Branch.

Otherwise, if switch 37 is off, weight-sensing switch 150 is monitored. When the person stands up, this switch is turned off.

After getting up, if the person needs time to wipe while standing, they can still delay flushing by actuating the foot switch for a moment. This actuation of the foot switch sends the program to the above-mentioned Delayed Flush Branch. If switch 37 stays off, the program enters the completion of the cycle.

If the program is diverted to the Short Flush Branch, the cycle goes through the following steps:

1. Valve 178 turns pressure outputs 50 and 51 off. Valve 179 turns pressure output 53 on.
2. Switch 150 is monitored. When the person stands up, it turns off.
3. Valve 178 turns pressure outputs pressure outputs 50 and 51 on.
4. Water flows from water jets 136 and 138 for one second. Valve 178 turns pressure outputs 50 and 51 off.
5. Simultaneously, valve 179 turns pressure output 53 on.
6. Water flows form water jet 140 for one second.
7. Valve 179 turns power output 53 and water jet 140 off.
8. The program enters the completion end of the cycle.

If the program is diverted to the Delayed Flush Branch, the follows occurs:

1. After a three-second delay, foot switch 37 is monitored. The person can start flushing be stepping on the switch for a moment. This will start the completion end of the cycle. Otherwise, the cycle will complete after a 45-second delay.
2. When any branch of the program reaches the completion end of the cycle, then, a three-second delay is provided, followed by the following programmed events:

3. Valve 183 turns pressure output 55 on and pressure output 57 off.
4. Pressurized water expands one bellows 110. This causes the other bellows 110 to contract.
5. The flap-and-cup actuating mechanism opens cup 32 and flap 30. There is a 1.5-second delay—long enough for waste and water in a bowl to fall through a waste passageway into a sewer pipe.
6. Valve 178 opens power outputs 50 and 51 to rinse the bowl. Valve 183 turns pressure output 55 off and pressures output 57 on.
7. Hydraulic pressure then urges bellows 110 to close flap 30 and cup 32. There is a one-second delay.
8. Exhaust fan 39 then stops. Simultaneously, valve 178 turns pressure outputs 50 and 51 off. This completes the cycle and the program returns to the starting position.

In summary, it is seen that our toilet is very water frugal; it operates automatically, promptly, and thoroughly in two modes, one for urine and one for feces, thus, it can rinse and flush with a average of about 1.5 liters of water—conventional domestic, commercial, and public toilets average six, twelve, or more liters per flush. Consequently, our toilet reduces indoor water consumption by about 30%. A reduction of 30% of the indoor water consumption of a city without gardens can permit such a community to increase its population by almost 30% without having to provide more water of drinking quality. Thus, state and city governments in 10 arid western states of America can avoid or defer new taxes to pay the upstream and downstream costs of providing and processing water.

Furthermore, our waste passageway has two further advantages, it is vertical and it does not bend. Consequently, waste is virtually free to flush gravitationally into a sewer pipe. Since our waste passageway has no slopes or bends to impede the momentum of solids, our toilet needs but a fraction of the water that a siphon structure needs to carry a given mass of waste in the passageway and an adjoining sewer.

Furthermore, our toilet rarely requires a second rinse or flush. When a second rinse or flush is needed, it is available within a second or two. Consequently, impatient people, and those in a hurry, are far less likely to leave solid waste in the bowl of our toilet the way that users of conventional toilets often do when they are in a hurry or become impatient with a slow-filling tank or pump. Thus, our toilet is more suitable for public bathrooms where people are more apt to be in a hurry or more impatient of delays because it can be rinsed or flushed again within one second.

Our toilet does not reflux. Siphon toilets always reflux. Even the most efficiently flushing siphon toilets reflux solid waste.

The above rinsing and flushing times and water volumes are but those we have chosen for our preferred embodiment. These rinsing and flushing times and rinsing volumes and pressures can be adjusted at the factory according to user needs and preferences. Also, the user has options to buy a variety of ready-made add-on programs or to buy a programmable logic device which the user can program.

Rinsing and Flushing Urine—Sitting Urinators—FIGS. 1, 8, and 19

Assume a female or a man sits to urinate (FIG. 1). When they stand, rinsing starts as if they were sitting to defecate (FIG. 8). To stop this wasteful rinse, the person momentarily actuates the foot switch (FIG. 1). The toilet stops rinsing.

After the user stands, rinsing and flushing occurs according to the flowchart shown in FIG. 19.

To summarize, a person who sits to urinate uses more water than a person who stands to urinate. How much additional water depends on how soon the person activates the foot switch (control flowchart, FIG. 19). If they do not activate the foot switch, they use as much water as if they had defecated—a lot of water that they need not have squandered.

Should the person forget to activate the foot switch, our toilet would still consume about a sixth to a third of the water that a siphon toilet would.

In Summary, to Rinse and Flush our Toilet:

1. a person who stands to urinate merely steps activates the foot switch,
2. to defecate they need only sit on the seat, and
3. to conserve water when sitting to urinate, they merely activate the foot switch with a heel.

Rinsing and Flushing During a Power Outage—FIGS. 1, 2, 11, and 12

FIGS. 2, 11, and 12 show two hand-plungers 29 and 31 on top of control cabinet 28. Plungers 29 and 31 insert into and are integral parts, respectively, of conventional water-valve 178 and 183. In the on, down, position, plungers 29 and 31, respectively, open valves 178 and 184 and, thus, respectively, cause rinsing and flushing of bowl 71 to occur as follows:

When a person holds plunger 29 down, jet orifice 136 rinses bowl area 142 and upper bowl area 148 and jet orifice 138 rinses bowl area 144 and lower bowl area 148 (FIG. 8).

When a person holds plunger 31 down, water valve 183 opens flap 31 and cup 32 and, the toilet flushes.

Operation of the Valve Plungers

With appropriate use of plunger 29 and 31 on top of the control cabinet, a person wishing to defecate during a power outage can readily and effectively achieve the following:

(1) Accumulate about three liters of rinse water in the bowl.
(2) Defecate and wipe in comfort.
(3) If feces or toilet tissue are stuck to the bowl above the waterline, the person can rinse them of the wall into the water.
(4) Keep the flap and cup open until the contents of the bowl and cylinder have fallen into the sewer pipe.
(5) Close the flap and cup, and
(6) Fills the cylinder with clean water. This re-establishes a clean water seal as follows: Water seeps past the flap into the closed cup. Since the upper rim of the closed cup is higher than the flap, the seepage recreates a clean water seal.

Assume a person wishes to stand to urinate during a power outage. The person first urinates and, then, at leisure, opens the flap and cup with flush plunger 31, rinses urine with rinse plunger 29, releases plunger 31 to close the flap and cup, re-establishes a clean main water seal by continuing to actuate rinse plunger 29, and, then, releases plunger 29.

Assume a person wishes to stand to urinate during a power outage. The person first urinates and, then, proceeds to rinse (briefly), flush, and re-establish a clean main water seal as described above.

Accordingly, a person may easily rinse and flush our toilet during a power outage. Furthermore, in a power outage, the slope of the seat centers the person as well as if there were no power outage. Thus, the feces of the person drop into the deepest and steepest part of the bowl where, as described above, they are least likely to cause smearing that would need further rinsing. In a power outage, apertures enclosed by the seat and rim continue to help prevent feces from sticking to the seat, the rim, or to the rear of the toilet bowl. Consequently, even, in a power outage our toilet rinses, flushes, and stays clean.

Positioning and Apertures—FIGS. 1, 9, 10

As mentioned above, the configuration of our seat, rim, and the apertures that they enclose complement each other. Together they keep our toilet cleaner and requiring less rinse water, and, hence, less flush water, as follows:

FIG. 1 shows a rear part of rim 22 and rear part 25 of seat 24 sloping upward and backward at similar angles. The rear of the rim and the seat slope upward and backward at angle of about 50° to 70° for a distance of about 10 to 18 cm. In our preferred embodiment, seat part 25 slopes upward and backward at an angle of about 60° from seat 24 for a distance of about 16 cm. The upward and backward sloping begins at imaginary line 186, shown in FIGS. 9 and 10. In our preferred embodiment, imaginary line 186 is located vertically above and about one and quarter centimeters behind the cylinder. This latter location can vary from about 3 cm behind the cylinder to about 2 cm in front of the back wall of the cylinder. Additionally, the top of rear sloping part 25 (FIG. 1) of seat 24 is narrow, about 2 cm deep from front to rear. The distance between the top of rear sloping part 25 and cabinet 28 is also narrow, about 1 cm. Since a user can not sit on top of rear sloping part 25 they are unlikely to foul it with feces.

The rear part of rim 22 (FIG. 1) slopes upward and backward at an angle and for a distance similar to that of the seat.

FIG. 10 shows our toilet from above. Seat part 24 and seat part 25 and lid parts 26 and 27 are raised. Rim 22 surrounds an aperture comprising a horizontal front part 176 and rear part 177. Aperture part 177 slopes upward and backward at an angle similar to the slope of the rim, as shown in FIG. 1. In our preferred embodiment, aperture 177 slopes up and back for about 8 cm. Aperture 177 can slope upward and backward for a distance from 5 to 10 cm.

FIG. 9 shows the toilet from above with the seat down and the lid in the fully up position. Seat part 24 and seat part 25 surround an aperture comprising a horizontal front part 17 and a rear part 175. Aperture part 175, not shown in FIG. 1, slopes upward and backward at an angle similar to that of the sloping rear of the seat and the rim, as shown in FIG. 1. In our preferred embodiment, aperture 175 and aperture 177 slope up and back for about 8 cm. However, aperture 175 and aperture 177 can slope up and back for a distance of about 5 to 10 cm.

When the lid is drawn up fully, as shown in FIG. 9, it provides users with a broad, sturdy, and comfortable chair-like backrest.

Slopes and Apertures—FIGS. 1,9 and 10

Assume seat 24 (FIG. 9) is closed, in the down position, and a person sits to defecate. Compared to a human body, seat part 25 is relatively rigid. The following will help clarify how the slopes and apertures complement each other and accommodate the varied configurations and densities of the human body to prevent soiling of the seat, rim, and rear of the toilet bowl.

A normal adult human pelvic-bone cage has the shape of a rigid funnel with a wide top opening and a narrow bottom opening. The bottom of the pelvis tilts backward. The human anus is placed within a cleavage between two buttocks. When a person sits on a toilet seat a relatively large mass of soft tissue separates the anus from the walls of a toilet bowl located to the right and to the left. However, relatively very little tissue separates the anus from the upper rear wall of a toilet bowl or an overhanging-rim or -seat.

Consequently, feces can eject explosively to the right and to the left to smear only bowl that is below the lower level of the buttocks. However, semi-liquid feces commonly eject explosively to the rear against the upper wall of bowls and the underside of conventional rims and seats.

The rigid sloping part 25 of our toilet seat (shown in FIG. 9) limits how far back a defecating adult may position their rigid sacrum. Consequently, when a person defecates while sitting in this position which places them over the rearward apertures that our seat and rim enclose, they are much less likely to smear the back of the seat, rim, and rear of the bowl. However, a user of conventional toilets readily soils the seat and rim and smears the bowl because the seats, rims, and apertures are not sized and configured to insure that feces free fall unimpeded into the deepest and steepest parts of the bowl.

Furthermore, the above-mentioned slopes of the seat and rim help center, or help seat, the anus of an average-sized person, who is sitting with their sacrum against the back of the seat, over an inlet to a cylinder where accumulated rinse water is deepest and the wall of the bowl is steepest. This is where feces are most likely to land in water and least likely to strike the bowl before striking water, and, hence, require less rinsing.

Additionally, conventional toilets provide a user with a horizontal or sloping seat and a relatively large area behind the seat above which they can place their anus-and consequently soil. However, there is too little room—about 2 cm—for a person to sit on the top of sloping rear part 25 (FIG. 1) of seat 24 of our toilet. This advantage is suitable for public toilets that dispense with tanks or lids.

In summary, our toilet seat, rim, and the apertures that they enclose complement the natural anatomy of the human pelvis, buttocks, and anus to help prevent feces from fouling our toilet.

Positioning of Children and Small People—FIGS. 11–13

Conventional seats do not take into account the shorter front-to-back sitting anatomy of small people or help to center, or help seat, them with respect to the deepest water or the steepest part of toilet bowls. Our toilet caters to the shorter front to back sitting anatomy of children and small people as follows:

FIG. 11 shows front part 26 of the lid leaning against control cabinet 28. This part of the lid is pivoted up on hinge 188 (not shown in FIG. 11 but shown in FIGS. 10, 13A, and 13B.). When articulated as shown, the lid prevents a person seated to defecate or to urinate from sitting on the rear of seat part 24 or on seat part 25. It also prevents them from sitting over the apertures respectively surrounded by the rear of seat 24 and seat part 25.

This articulation of the lid provides small people with a seat and backrest that better matches their shorter front-to-back sitting anatomy. Thus, this articulation of the lid centers or helps seat them comfortably over water and bowl that are respectively deeper and steeper than the water and bowl into which they would defecate if the were to sit on the front of the seat. Consequently, this articulation of the lid reduces smearing of the toilet bowl by small people and thus saves further water.

Furthermore, the rear of conventional toilet seats is too wide for comfort for many small people. Consequently, they tend to sit on the front of the seat to urinate and defecate. Accordingly, they are more apt to smear the bowl because in many conventional toilets there is little or no water in the front of the bowl.

FIG. 12 shows the lid in the fully down, or closed position. In this configuration lid part 26 is horizontal and lid part 27 slopes upward and backward. Lid parts 26 and 27 pivot on a conventional piano hinge 188. The lid pars are shover locked together by a locking mechanism 181. Hinge 188 and locking mechanism 181 are shown in more detail in FIGS. 13A and 13B.

Figure 13A:
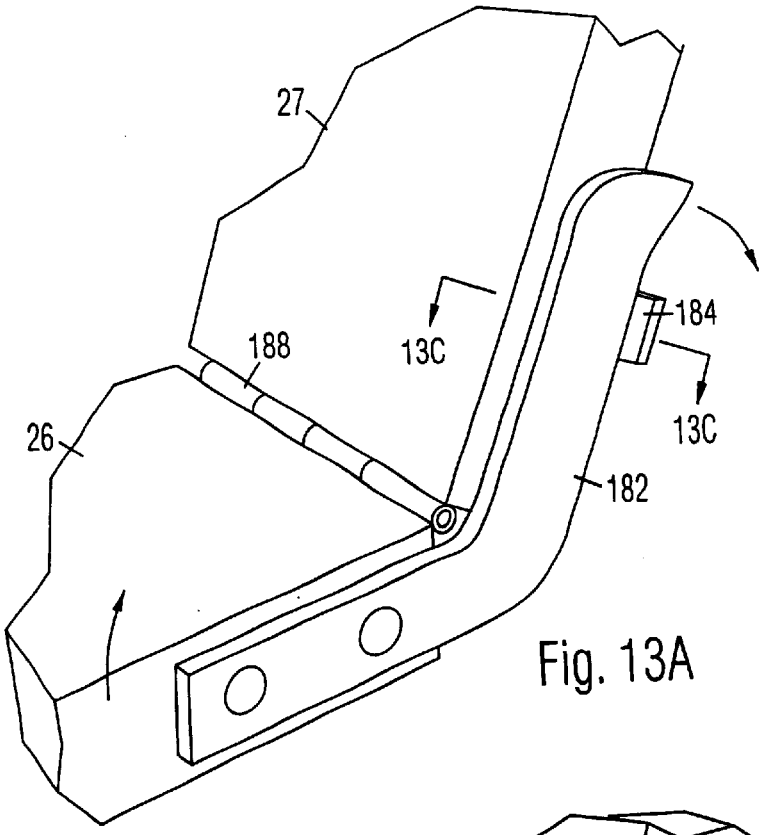
FIG. 13A shows from right to left the lid-lock locked as shown in FIGS. 10 and 13.

FIG. 13A shows the locking mechanism in more detail, from above and from right to left. Catch 184 prevents locking arm 182 from moving backwards. This arrangement of the catch and the locking arm prevents lid pat 26 from rotating around hinge 188.

Figure 13C:
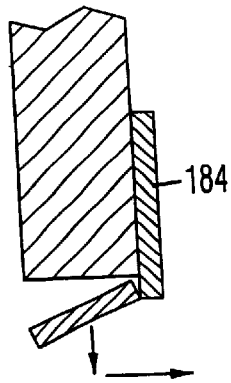
FIG. 13C is a cross section through a catch of the unlocked lid lock.
Figure 13B:
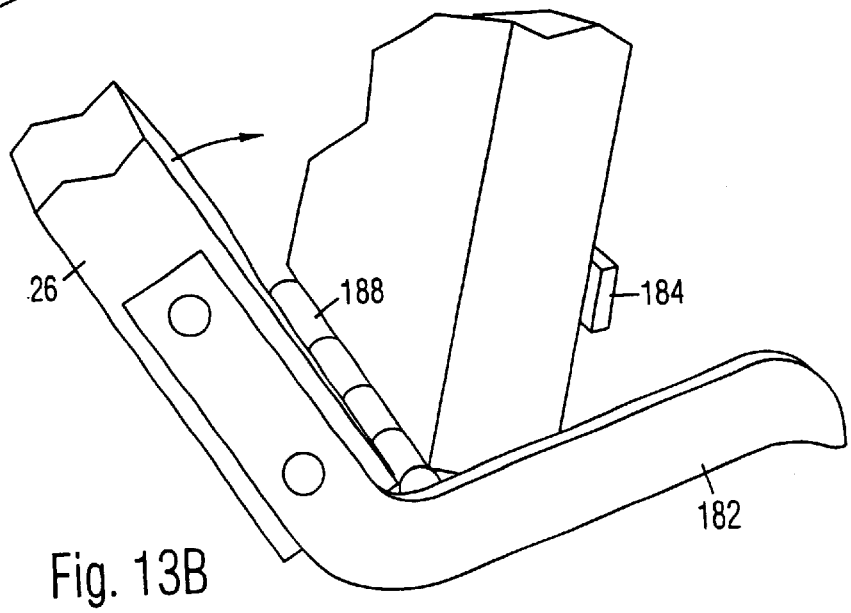
FIG. 13B shows from right to left the lid lock unlocked as shown in FIGS. 9 and 11.

FIG. 13B shows the locking mechanism open and lid part 26 folded up. FIG. 13C shows the locking mechanism in cross section, open through catch 184.

The purpose of the locking mechanism is to secure the lid as it conforms to the angular shape of the seat (FIG. 10) when the seat is raised for those who stand to urinate. To unlock the mechanism, a person presses locking arm 182 outward. This releases the locking arm from catch 184 (FIG. 13B and FIG. 13C).

Other Toilet Operations

Our toilet accommodates users who wish to rinse and flush a clogged bowl or to flush a clogged sewer pipe, as follows:

(1) Rinsing And Flushing Clogged Cylinder Inlet—FIGS. 14–15

FIG. 14 shows a rim 22, an inlet 154 to a cylinder, and two jets of water 155 from water jets 156 and 158. The jets of water converge on the inlet.

Siphon toilets are likely to clog in part because their waste passageway is convoluted and only 3.67 to 6.73 cm wide. Our toilet, on the other hand, is relatively unlikely to clog as its passageway is 9.7 cm wide and it connects vertically with the sewer pipe. Should our toilet clog it will most likely clog by clogging inlet 154. Inlet 154 is also shown in FIGS. 8 and 11. The following shows why and how our toilet can unclog itself:

A clog is usually composed of soft human waste and toilet tissue. A person can readily break up such a clog by hand with a rod. However, our toilet has special water jets 156 and 158 (FIGS. 14 and 15). They are designed to break up and loosen such a clog so that the latter falls of its own weight as follows:

FIG. 15 shows a cross section of the toilet, shown in FIG. 14 from right to left. The section shows water 155 issuing from water jet 158.

Assume a soft clog covers inlet 154 to the cylinder. A person actuates and continues to actuate foot switch 37. At first, as shown in the flowchart of FIG. 18, the program cycle is the same as the cycle which occurs when the foot switch is actuated for a moment.

Valve 178 opens and closes and then valve 179 opens and closes. As consequence, pressure outputs 50 and 51 open and close and then pressure output 53 opens and closes. Thus, water Jets 136, 138, and 140 rinse the entire wall of the bowl for second each.

After a delay of 2 seconds, as shown in the diamond shape in FIG. 18, the program monitors switch 37. As result of the controls finding switch 37 on, an Unclogging Branch is actuated. Valve 180 opens and activates pressure output 15, which (via a conduit not shown) activates water jets 156 and 158 (FIG. 14), which cause a pair of water jets 155 to converge on cylinder inlet 154.

The flap and cup open. They stay open as long as the person keeps pressing the foot switch. The power of the jets of water and the spatial orientation of the issuing orifices causes the converging jets to make minimal contact with the all of the bowl. FIG. 15 also shows that were inlet 154 free of a clog, the jets would hit the top of fully open flap 162.

When the inlet is clogged, these powerful and highly focused jets of water tear at the perimeter of the relatively soft waste of which the clog is made. The perimeter of the waste gives way. The jets get under the clog and tear at its underside, thus further reducing the diameter of the clog. As soon as the diameter of the clog is less than that of cylinder 48, the clog promptly falls of its own weight into sewer pipe 36.

The person releases the foot switch. The program (FIG. 18) goes to the completion of the cycle. Rinsing stops. The flap (and cup) closes. Water jets 136 and 138, shown in FIG. 8, infuse the bowl briefly and thereby re-establish water seal 40 (FIG. 1), with clean water. Consequently, our toilet is very unlikely to need a plumber's plunger or a snake.

Figure 16:
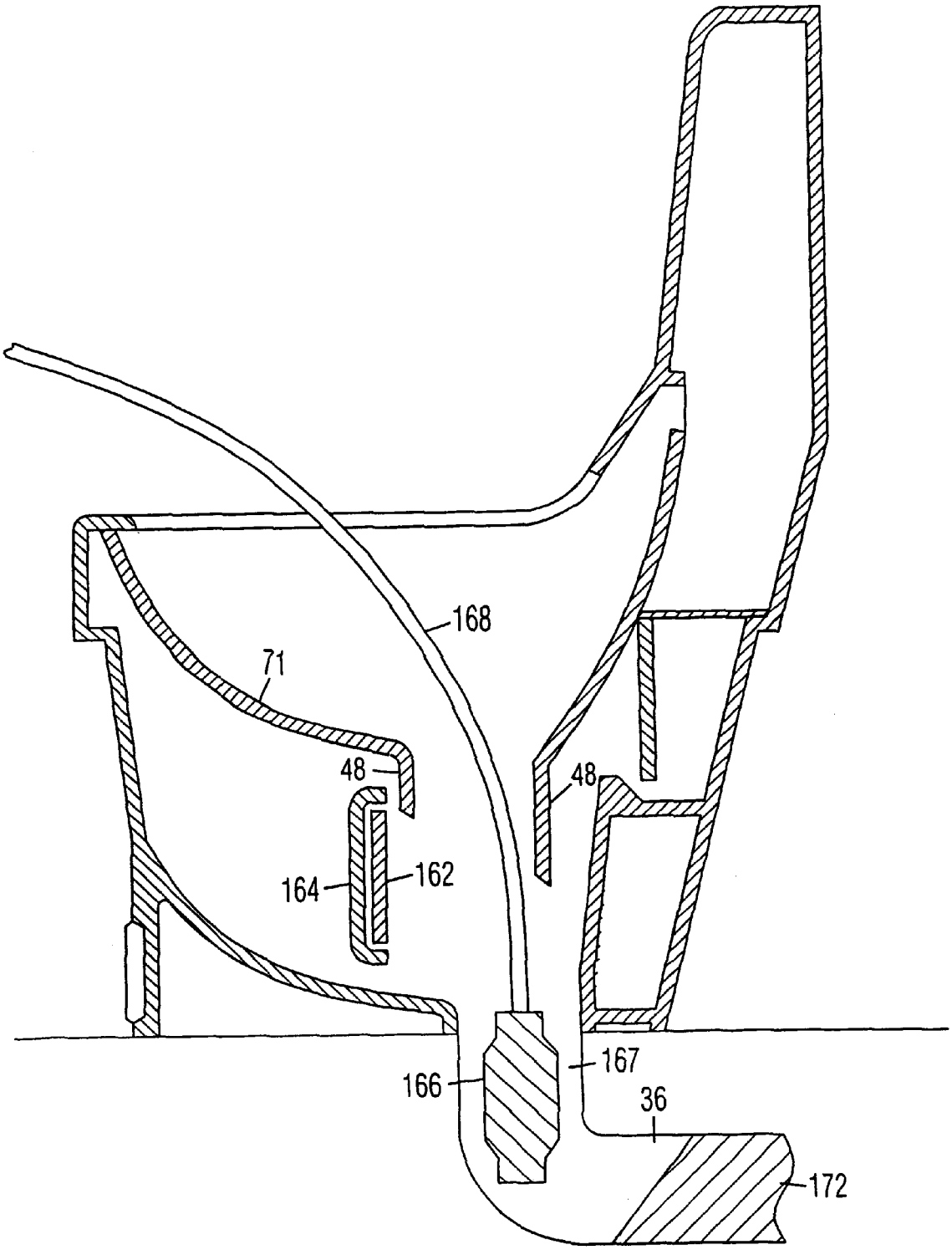
FIG. 16 shows a cross-section from right to left through a centerline of the toilet, a clog in an adjoining sewer, and a commercial clog-removing device.
Figure 17:
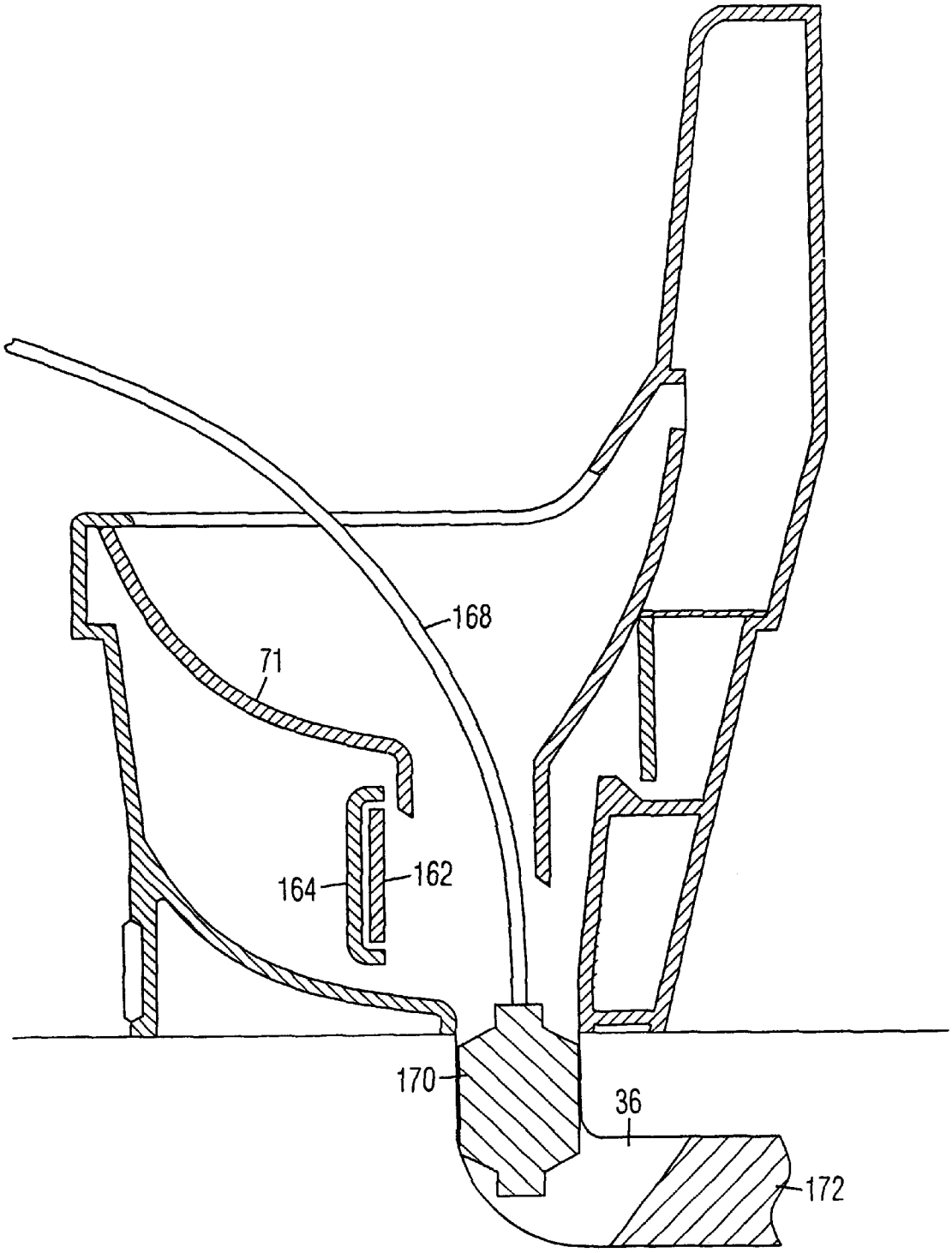
FIG. 17 shows a similar view in which the clog-removing device of FIG. 16 is shown inflated.

(2) Flushing A Clog From An Adjoining Sewer Pipe—FIGS. 16–17

Sewer pipes adjoining toilets rarely clog. When they do, the household generally needs the service of a plumber because others seldom have the necessary experience, skill, and equipment.

Our toilet can flush a sewer pipe free of this kind of clog in a relatively inexpensive manner, as follows:

FIG. 16 shows a cross-section from right to left through a centerline of a toilet and of an adjoining sewer pipe 36. A clog 172 blocks the sewer pipe. A commercial clog-removing plumbing device is show in waste passageway 167 and in sewer pipe 36.

Inflatable part 166 of the plumbing device is shown deflated within the sewer pipe. A cup 164 is shown fully open in FIGS. 15 and 16 behind and shielded by a flap 162 which is also fully open. Attached to the plumbing device is a conventional garden hose 168. The other end of the hose is attached to a faucet (not shown).

FIG. 17 shows a similar view in which the inflatable part 170 is shown inflated within the sewer pipe.

Operation: A handy person can resolve such a clogged sewer pipe quickly and safely with the following flushing technique.

The person raises the seat. Proximity switch 151 is inactivated. The person presses manual switch 160, (FIGS. 9, 10, 11, and 12). In response to activation of manual switch 160 the following operations occur as shown in the control flowchart (FIG. 20):

Valve 183 is actuated. Flap 162 and cup 164 open. No water issues from the water jets. The flap and cup stay open and the water jets stay inactive until the person presses the switch once more.

Since the flap and cup are open and no water flows, the person can readily see the length of waste passageway 167 from bowl 71 to a first bend of- the adjoining sewer pipe 36 (commonly, 7.62 to 10.16 cm in diameter). The person can clearly see the fully retracted flap 162. However, the person can barely see fully retracted cup 164, (FIGS. 16 and 17), because it is below bowl 71 and behind cylinder 48 and behind retracted flap 162.

The following helps to clarify why the sewer pipe can safely be flushed from our toilet with a commercial plumbing device:

The device can expand to fill sewer pipes with inside diameters up to 15.2 cm. The collapsed rubber part, the widest part of the device, is about 6.4 cm in diameter. However, Our waste passageway 167 is approximately 7.9 cm in diameter. Accordingly, a handy person can readily and safely thread the plumbing device collapsed, and the attached garden hose, through the passageway of our toilet and safely inflate the plumbing device as follows:

The person turns the cold water slowly to full force. The device expands and tightly locks itself in the sewer pipe, as shown in FIG. 17. When inflation is complete, powerful pulsating jets from the water reach clog 172, loosen it, and flush it to a wider part of an adjoining sewer system. Then, the person turns off the faucet. The inflated part collapses. The device is safely withdrawn from the toilet.

Returning to flowchart in FIG. 20, the person turns the manual switch off to complete the program to return the toilet to its normal state as follows:

Valve 183 turns pressure output 55 off and pressure output 57 on and bellows 110 closes the flap and cup. Simultaneously, valve 178 opens pressure outputs 50 and 51 for one and half seconds.

Water jets 156 and 158 rinse the bowl with clean water for one and a half seconds to renew the main water seal in the closed cup and in the cylinder above the closed flap.

Valve 178 turns off pressure outputs 50 and 51. This completes the cycle.

Persons who use our toilet in this way have the satisfaction of doing their own plumbing and saving money. This plumbing technique does not work in a conventional toilet because the above device can not bend. Thus to inflate this powerful device in a toilet equipped with a weir or a bend, as opposed to in a sewer pipe, is to risk grave damage to the toilet.

Protective Seat Covers—FIG. 9

A person can, without touching the toilet with bare hands, readily and firmly wedge a seat cover into space 173 between the lid and the seat. An inexpensive rearward extension to the cover and its aperture to match the configuration of our seat and aperture makes the cover easier to secure. Since this cover is less apt to slip, people who dare not sit to defecate are less likely to soil the seat and rim, or rear of the bowl.

Conclusions

From the above it will be apparent that our toilet has several substantial advantages over conventional toilets. These advantages are summarized as follows:

When flushing our toilet employs fewer physical principles. Siphonic flushing depends on cohesiveness of water and gravity. Our flushing depends on gravity alone.

Our toilet flushes and carries waste better than siphon toilets and with a smaller amount of water because its waste passageway is wider and straighter. It does not reflux waste back into the bowl.

Furthermore, our toilet rinses with much greater efficiency than conventional toilets because it taps all of the hydraulic power available from the adjoining water main to rinse no more than two areas of the bowl at a time instead of eight to ten areas. It is particularly good at rinsing smears that conventional toilets are particularly poor at rinsing, smears high on the rear wall of the bowl. A siphon toilet must also apportion a considerable part of its hydraulic power to flushing while it is rinsing. Accordingly, our toilet is more suitable for residences, businesses, and public places.

As mentioned above, our toilet is designed to conserve additional water by using less water to rinse and flush urine than feces. It averages about 1.5 liter per flush per day—a fraction of the 6 and 12 liters that siphon toilets use for every flush. Consequently, our toilet places less pressure on upstream and downstream water resources and costs, Our toilet can contribute to the water conservation which water-experts warn must be a big part of the answer to the water woes of water-scare and drought-prone states. Otherwise, American cities could be without water for several hours a day like Tokyo.

Our flap and cup contribute to a cleaner main water seal than conventional toilets because the flap prevents a considerable amount of liquid and solid waste from entering the cup, whose sole function it is to catch clean water to create a cleaner water seal as described above.

The slope of the rim and the seat, the apertures within the rim and seat, and their configurational relationships to the lid and cabinet all complement each other to keep the seat, the rim, and the rear wall of the bowl cleaner. The slope of the seat also centers users approximately over the deepest water and the steepest part of the bowl, the cylinder, where smearing is least likely to occur and hence rinsing is least needed.

The above-mentioned features make it bacteriologically safer for a person to touch by hand the above-mentioned surfaces in a water closet or bathroom that is equipped with our toilet.

Our automatic rinsing and flushing features save water that people-powered mechanical rinsing linkages squander. This automation is particularly useful in public restrooms because it automatically keeps the toilets better flushed, the rooms cleaner, water bills lower, and the air fresher.

Additionally, in public bathrooms where people are commonly in too much of a hurry, or too impatient, to wait for a conventional tank, or pump, to refill, can rinse or flush our bowl again within one second.

Furthermore, many people are psychologically conditioned to want to urinate and defecate on hearing running water in a bathroom. For some this conditioning is powerful. Our toilet stimulates these people because they hear the sounds of water rinsing the toilet bowl as soon as they sit on the seat. However, the same people can sitting on a siphon toilet without defecating. This delay can prevent others from using the bathroom. Consequently, our toilet is preferable for a public bathroom, especially for a crowded public bathroom.

Additionally, in public bathrooms where people are commonly in too much of a hurry, or too impatient, to wait for a conventional tank, or pump to refill with rinse and flush water, our toilet can rinse and flush repeatedly at intervals of one second.

A man who stands to urinate finds relatively little water, the main water seal, in the bowl. Thus, it is much easier for him to urinate silently.

To rinse and to flush our toilet during a power outage a person needs minimal skill and strength. Consequently, our toilet is preferable for water closets and bathrooms in industrialized countries where power outages can occur and for many water closets and bathrooms in third world countries where power outages are frequent.

Base 20 encases the bowl module and the hydromechanical flap-and-cup module the flap-and-cup actuating within gently curving exterior surfaces. Consequently, the exterior of our toilet stays cleaner and is easier to clean than the many sharp curves and angles that characterize the exterior of a siphon structure.

Our clog-rinsing feature precludes the need for standby plungers or snakes.

A handy person can safely clear a clogged sewer from our toilet with a simple and easy-to-use conventional plumbing device without the services and expense of a plumber.

Our toilet is user-friendly. People need no upper limbs to operate it.

Ramifications

While the above description contains many specificities, these should not be construed as limitations on the scope of the invention, but merely as examples of preferred embodiments. Many ramifications are possible. For example:

Our preferred embodiment has a cylinder diameter of 7.9 cm. The toilet is comfortably high for most people. However: the part of the waste passageway that is cylindrical in our preferred embodiment can have any transverse shape of approximately 2.5 to 10 cm in diameter that the flap can close.

A fully functional version of our toilet can be made by reducing the length and diameter of the cylinder, and the height of the sub-assembly that opens and closes the flap and cup. Accordingly, a cylinder between 2 to 3 cm wide and 1 to 2 cm high permits a manufacturer to make a toilet to seat small people in comfort.

A manufacturer can, with at little expense, can by making the cylinder appropriately longer, make a toilet high enough to seat extremely tall people, for example 220 cm high. This toilet would retain the same straight waste passageway, subassembly, flap, cup, shutter, bowl, rim, seat, etc., of our preferred embodiment.

The cylindrical part of our preferred embodiment can have any shape that lends itself to a lower edge against which the flap can align itself closely enough to restrain solid waste until it is time for a flush to occur.

Additionally, the flap, cup, sub-assembly, etc can be made of variety of durable plastics, metals, etc, and, or, glazed to minimize smearing, to enhance rinsing, and to help solid wastes fall with less resistance into the sewer.

A maker can apply a conventional super-hydrophilic photocatalitic finish, such as titanium dioxide, to a seat, rim, bowl, and flap of our toilet. The photocatalyst can automatically be briefly irradiated by a conventional ultra-violet source when a person stands up from the toilet. The UV-irradiated photocatalyst can liberate nascent oxygen which can oxidize and, thus, decompose, organic solids, liquids, and gases such as feces, bacteria, urine, and their offensive odors.

Furthermore, the above mentioned finish on a toilet surface can reduce the contact angle between water and the photocatalyst on the surface to such a low degree that water, urine, and water-rich feces adhere less firmly to the photocatalytic surface. Accordingly, urine, and feces are less likely to smear the toilet and, thus, are rinsed and flushed with less water.

In areas some places finely divided chemicals and organic compounds can flow through a conventional water filter to our bellows. To counter the above, a maker can sell bellows assemblies with hydro-pneumatic connections that use air pressurized by pressurized by main water to expand and contract the bellows in such a way that the main water never enters the bellows.

A maker can embed a heating element into the seat to warm the buttocks of people using toilets in cold rooms. Furthermore, a maker can make and sell add-on buttock-warmers.

With conventional voice-sensitive remote controls handicapped persons can operate our toilet. They do not need lower body dexterity, or limbs.

In some places sewer pipes adjoining toilets are customarily laid, or can be laid, at a gradient that can give our toilet greater carrying power that the minimum gradient permitted by the relevant U.S. plumbing code. Accordingly, in such places our toilet can carry feces and tissue to a septic tank or to a sewer main with less flush water than that described above.

A wider rounder toilet bowl resting on top of a free-standing pedestal can allow two or more people to urinate into the bowl at one time and rinse and flush with about one third of a liter of water. Cigarette butts and tissue can readily pass through the wide and straight passageway without clogging it. This version of the toilet can be particularity useful in crowd-prone public bathrooms where males in a hurry squander much water by using conventional sit-down toilets as urinals.

Air pressure, conventional electric motors, and hydraulically-urged fluids can operate the bellows to open and close our flap and cup in planes, trains, workshops, etc. The above, or conventional water pumps, can pressurize the water that's needed to rinse well.

A variety of conventional remote controls can extend the usefulness of this toilet. For example, in a high-tech public bathroom, a motion-sensing device in the doorway of each cabinet can trigger an automatic flush when someone enters and leaves without sitting or using the foot switch. Handicapped people can use a voice-sensitive remote control instead of a foot switch.

The maker can sell a foot switch that sits on or close to the floor and that is raised or insulated against water or urine on the floor.

Additionally, the maker can use a variety of plastics, metals, etc. in the flap, cup, sub-assembly, etc.

The centerline of the cylinder can be decentered 2.5 to 10 centimeters with respect to the centerline of sewer inlet to allow for variations in the structural proportions of buildings.

To compensate for low pressure in water mains, the maker can provide additional water jets for rinsing the bowl.

The maker can sell a variety of embedded systems chips that control the occurrence, duration, and pattern of rinses; that control when and for how long the flap and cup stay open; and can sell variations on the programs for unclogging the cylinder and the sewer pipe.

A maker can sell a valve block in which the water valves respond electronically and to hand plungers. Such valve blocks will be especially useful in places where power outages are common. Makers can also sell valve blocks in which all of the water valves respond only to hand plungers. Such valve blocks will be work in places that have no electricity. In both cases, our toilet will rinse, flush, and stay clean better than conventional toilets.

Waters seals tend to evaporate in toilets that are liable to be left unrinsed and unflushed for long periods in hot areas where water evaporates rapidly. A maker can help prevent the bathroom from being left without a water seal by selling programs that automatically renew the water seals about every month. The maker can also sell programs responsive and remote controls. Thus, owner can briefly rinse and flush to renew both water seals via a telephone connection from anywhere on earth.

The maker can also sell the following:

Programmable logic devices that one skilled in the art may program as they wish, On\off indicators of electric power strong enough to act as night lights, Replacement lids, seats, bowl, rim, and control modules or license others to make and sell them.

Easily replaceable or self-cleaning water filters, water-blocks, electric motors, pneumatic motors, etc., Standby electric devices to provide seamless change of power during a power outage, Disposable seat covers, bases,and bowls, and sub-assemblies customized for small people.

Thus, the scope of the invention should be determined by the appended claims and legal equivalents, rather than by the examples given.

We claim:

1. A toilet having a seat, a bowl, and a rim, which permit a user to rinse said bowl free of feces at a first attempt, comprising:

(a) said seat and rim each having a solid horizontal front part with a horizontal aperture so as to permit vertically falling feces to fall through said apertures into said bowl without soiling said solid horizontal front parts of said seat and rim, (b) said solid horizontal front parts of said seat and rim each having a solid rear part which slopes upward and rearward, (c) said solid rear part of said seat and rim each having an upward and rearward sloping aperture within said solid rear part so as to permit vertically falling feces to fall through said sloping aperture into said bowl without soiling said sloping solid rear part of said seat and rim, (d) said bowl having a cylindrically-shaped bottom outlet which is the deepest and steepest part of said bowl so that feces are less likely to stick to said bowl and so that said user can readily dislodge said feces from said bowl with less rinse and flush water, (e) said solid rear part of said seat and rim being higher than said cylindrically-shaped bottom outlet, (f) said solid sloping rear part of said seat being shaped to limit rearward placement of a sacrum and thus, of an anus, of a user sitting on said solid horizontal part of said seat, and (g) said upward and rearward sloping aperture of said seat and rim each being shaped to permit vertically-falling feces of said user, who is sitting so that said rearward placement of said sacrum and said anus is limited by said solid sloping rear part of said seat, so that said vertically-falling feces more readily fall through said sloping apertures towards said bottom outlet without soiling said solid sloping rear part of said seat and rim, whereby said upward and rearward sloping apertures within said solid upward and rearward sloping seat part and within said solid upward and rearward sloping rim parts permit said toilet user more readily to rinse said bowl free of feces at a first attempt with less water and thereby to save water.

2. The toilet of claim 1, wherein (h) said seat and rim each have a solid rear part that slopes upward and backward at about 50° to 70° from a horizontal plane for a distance of about 10 to 18 centimeters, (i) said sloping apertures within said solid rear parts of said seat and rim each slope upward and backward at an angle of about 50° to 70° from said horizontal plane for a distance of about 5 to 10 centimeters so that vertically-falling feces are more likely to fall freely through said apertures towards said bottom outlet of said bowl, and (j) said sloping apertures commence to slope from said horizontal plane at a transitional imaginary line being located above a rear part of said bottom outlet, which is adjacent the rear of said toilet, and said sloping apertures positioned from about 3 cm behind said rear part of said bottom outlet to about 2 cm in front of it so that said feces can free fall vertically towards said bottom outlet and will be less likely to soil said solid rear parts of said seat and rim and said bottom outlet of said bowl, whereby said sloping solid rear part of said toilet seat and rim can more readily stay free of feces and said user can more readily rinse said bowl free of feces at a first attempt and thereby to save water.

3. A toilet which can sequentially rinse different parts of a bowl surface of a toilet bowl free of feces and toilet tissue with less water, comprising:

(a) a toilet bowl having a bowl surface to which feces and urine can stick, (b) a plurality of on-off water valves that regulate a flow of pressurized water, (c) said water valves being arranged to open and close in response to hand actuated plunger and electronic means, (d) at least one of said plurality of water valves being connected to at least one of a plurality of water conduits and said at least one water conduit being connected to at least one of a plurality of water jets in said bowl for the purpose of rinsing one area of said bowl surface free of feces and urine with said pressurized water, (e) said at least one of said plurality of water conduits being fixedly and statically connected to said at least one jet so as to permit said pressurized water to flow through said at least one water valve, said at least one water conduit, and said at least one water jet so as to rinse said one area with a full force of said pressurized water, and (f) at least one other water valve other than said at least one water valve being fixedly and statically attached to at least two other conduits and at least two other water jets in said bowl so as to permit said pressurized water to flow through said two other water conduits and said two other water jets so as to rinse the remainder of said bowl surface with a full force of pressurized water, whereby said water valves can sequentially open and close so as to cause sequential rinsing of different parts of said bowl so as to free the entire of said bowl free of feces and urine at a first attempt with less water.

4. The toilet of claim 3, further including:

(g) a programmed embedded systems chip, (h) said chip being programmed to open and close said water valves, (i) said chip being also connected to respond to an electric signal from one weight-sensing switch located in a rim of said toilet, (j) said weight-sensing switch being connected to respond to the weight of a user sitting on the seat to defecate so that said weight of the sitting user promptly opens at least two of said water valves in sequence for a period to rinse said entire said bowl free of feces with a full force of said pressurized water while said user is still sitting.

5. The toilet of claim 4, further including:

(k) said plunger means which enable a toilet user, even in a power outage, to rinse said bowl with said full force of said pressurized water for a desired period so that the user, according to need, can rinse said urine with about 300 to 400 milliliters of water, and thereby saves water even in a power outage.

6. A rotatable flap and cup combination for flushing a toilet bowl free of solid waste so said cup can form a clean main water seal in said bowl, comprising:

(a) means for rinsing said bowl with clean water, (b) a rotatable flap being positioned within a waste passageway leading to a sewer pipe, (c) said rotatable flap being rotatably closed against a cylindrically-shaped bottom outlet of said bowl, (d) said flap being rotatably open downward and rearward from said bottom outlet, (e) a rotatable cup being within said waste passageway, (f) said rotatable cup being rotatably closed to surround said closed flap and said bottom outlet, (g) said cup being rotatably open downward and rearward from said bottom outlet and said closed flap, (h) said flap, when normally closed, being closely applied to said bottom outlet, (i) said cup, when normally closed, surrounding said closed flap and said bottom outlet of said bowl with water held within said cup to form a main water seal between said sewer pipe and said bowl, (j) springy flap means which enable said closed flap to retain solid waste in said bowl so as to permit rinse water in said bowl slowly to seep from said bowl to fill said closed cup, (k) means for opening and closing said flap and cup so as to permit solid waste in said bowl to flush freely and cleanly through said waste passageway into said sewer pipe without entering said cup upon the actuation thereof to open said flap and cup to an open position, and (l) so as to permit said clean rinse water to accumulate in said cup and bottom outlet when said flap and cup is in a close position, wherein said accumulated clean water surrounds said closed flap and bottom outlet so as to form a clean main water seal to prevent sewer gases from rising into said bowl.

7. The rotatable flap and cup combination of claim 6, wherein said springy means further including:

(m) a springy plate, (n) said springy plate having a dimple with a spherical top surface, (o) said springy plate being positioned so that said spherical top surface of said dimple is pressed against said bottom surface of said flap, so that when closing, said flap can tilt on said dimple so that said flap can more closely fit against said cylindrically-shaped bottom outlet of said toilet.

8. The rotatable flap and cup combination of claim 7, wherein said means for opening and closing said flap and cup further including:

(p) a hydro-mechanical linkage system which includes at least one hydraulically actuated vertical bellows, (q) said hydro-mechanical linkage system being arranged to actuate said flap and cup combination open and closed.

9. The rotatable flap and cup combination of claim 6, wherein said cup has a shutter, (r) said shutter being a downward curving extension of said cup within said waste passageway, (s) said cup being rotatably closable so as to cause said extension to block said waste passageway so as to prevent rats, coach-roaches, and other creatures from entering said toilet from said sewer pipe.

10. A method for sequentially rinsing an entire toilet bowl at a first attempt with less water, comprising:

(a) providing a plurality of on-off water valves that regulate a flow of pressurized water to rinse said bowl, (b) providing hand-actuated on-off plunger and electronic means to open and close said water valves to regulate rinsing of said bowl, (c) connecting at least one of said on-off water valves to a static and fixed water conduit and a static and fixed water jet in said bowl for the purpose of hydraulically rinsing feces and urine with a full force of said pressurized water from at least one area of said bowl, (d) connecting another of said plurality of on-off water valves other than said at least one on-off water valve to at least two other static and fixed conduits and two other static and fixed water jets in said bowl other than said one conduit and said one water jet to hydraulically rinse the remainder of said bowl with a full force of said pressurized water, and (e) rinsing said bowl sequentially by turning on said valves in sequence so that said full force of pressurized water rinses said entire bowl of said toilet, whereby said entire bowl can be rinsed free of said feces and urine at said first attempt and thus save rinse water.

11. The method of claim 10, further including:

(f) a programmed embedded systems chip (g) said chip being programmed to respond to an electric signal from a weight-sensing switch located in a rim of said toilet under a seat, (h) said chip being programmed to respond to the weight of a user who sits on said seat so as to promptly and automatically rinse said entire bowl with said full force of pressurized water.

12. The method of claim 10, wherein said hand-actuated on-off plunger means comprises at least two manually actuated on-off plungers being connected to at least two of said on-off water valves, whereby a toilet user can manually, even in a power outage, release said full force of said pressurized water to rinse urine with said full force of said pressurized water with about 300 to 400 milliliters of water and to rinse said urine and feces with an average of about 1.5 liter of water.

13. A method for enabling a user to flush a bowl of a toilet free of solid waste a first time with less water, comprising:

a) providing means for rinsing said bowl with clean water, b) providing said bowl with a cylindrically-shaped bottom outlet so as to be the deepest and steepest part of said bowl for receiving and pre-shaping solid waste prior to flushing of said solid waste, c) connecting said cylindrically-shaped bottom outlet to a waste passageway connected to a sewer pipe so that said solid waste can fall freely from said bowl into said sewer pipe, d) hinging a rotatable flap and cup within said waste passageway so said flap and cup can open and close with respect to said cylindrically-shaped bottom outlet of said bowl, e) providing flap-and-cup-closing means for closing said flap against said bottom outlet before closing said cup around said closed flap and said bottom outlet, f) providing flap-closing means for closing said flap closely against said bottom outlet so that said closed flap can retain solid waste in said bowl and permit water to seep gravitationally from said bowl to fill said cup being closed, g) closing said cup so that said closed cup surrounds said closed flap and said bottom outlet of said bowl so as to catch said clean rinse water seeping past said closed flap from said bowl so that said clean water surrounds said closed flap and said bottom outlet forms a clean main water seal so as to prevent sewer gases from rising into said bowl, h) opening said cup before said flap opens, i) opening said flap when said cup is substantially open so that said opening flap prevents said waste, as it falls through said waste passageway into said sewer pipe, from falling against said cup so that said cup remains clean, whereby said user flushes said bowl free of said pre-shaped solid waste at a first attempt with less water.

14. The method of claim 13, wherein said flap-closing means comprises a springy plate, and the method further including:

(i) connecting said springy plate to said flap, (j) said springy plate having a dimple with a spherical top surface so as to permit said flap, when closing, to tilt on said dimple and thereby to close said flap more closely against said bottom outlet of said bowl within said waste passageway, whereby said closed flap can more readily retain said solid waste within said bowl until it is time for flushing of said toilet to occur.

15. The method of claim 13, wherein (l) said toilet user automatically can open said flap to flush said bowl free of urine at a first attempt with about 300 to 400 milliliters of water and thereby automatically saves water.

16. The method of claim 13, further including:

(m) providing said cup with a downward-curving extension so that when said closed cup is rotated up said cup extension, in addition to said closed cup, blocks said waste passageway so as to prevent rats, coach roaches, and other creatures from entering said toilet from said sewer pipe.

17. The method of claim 13, further including:

(n) providing said toilet with hydraulically-actuated bellows which contract and expand in response to water pressure so as to open and close said flap and cup, (o) arranging said bellows so as to contain water, (p) connecting said bellows to an infusion line so that, when said bellows contracts to close said flap and cup after each flush to their normally closed positions, said bellows expels said contained water via said infusion line, (q) connecting said infusion line to a reservoir structure, capable of holding an exhaust water seal, so that said expelled water can fill said reservoir structure to reform said exhaust water seal after each flush, whereby said bellows automatically reforms said exhaust water seal so as to prevent sewer gases from entering a bathroom when said flap and cup are normally closed.

* * * * *